US005836398A

United States Patent [19]

White

[11] Patent Number: 5,836,398

[45] Date of Patent: Nov. 17, 1998

[54] VEHICLE MOUNTED FIRE FIGHTING SYSTEM

[75] Inventor: Richard W. White, San Diego, Calif.

[73] Assignee: FAV, Inc., San Diego, Calif.

[21] Appl. No.: 695,219

[22] Filed: Aug. 5, 1996

Related U.S. Application Data

[63] Continuation-in-part of Ser. No. 308,981, Sep. 20, 1994.

[51] Int. Cl.[6] ..... A62C 27/00

[52] U.S. Cl. ..... 169/24; 169/54; 169/62

[58] Field of Search ..... 169/24, 54, 62, 169/12, 91

[56] References Cited

U.S. PATENT DOCUMENTS

| | | | |
|---|---|---|---|
| 1,276,778 | 8/1918 | Loveczky | 244/60 |
| 1,351,700 | 8/1920 | Smith | 169/91 |
| 1,383,788 | 7/1921 | Clark . | |
| 1,767,098 | 6/1930 | Ruff | 169/62 |
| 1,849,411 | 3/1932 | Silva et al. | 169/91 |
| 2,340,006 | 1/1944 | MacGregor | 169/62 |
| 2,561,701 | 7/1951 | Hurlbert | 169/91 |
| 3,724,554 | 4/1973 | Rupert et al. . | |
| 3,785,439 | 1/1974 | Britt . | |
| 4,023,201 | 5/1977 | Faulkner | 169/69 |
| 4,129,185 | 12/1978 | Hasselbacher . | |
| 4,224,994 | 9/1980 | Tone et al. | 169/9 |
| 4,669,548 | 6/1987 | Colodner et al. | 169/12 |
| 4,875,526 | 10/1989 | Latino et al. | 169/24 |
| 5,113,946 | 5/1992 | Cooper . | |
| 5,301,756 | 4/1994 | Relyea et al. . | |

FOREIGN PATENT DOCUMENTS

| | | |
|---|---|---|
| 2568779 | 2/1986 | France . |
| 2602428 | 2/1988 | France . |
| 2652268 | 3/1991 | France . |
| 2680692 | 3/1993 | France . |
| 199817 | 8/1978 | Germany . |
| 3620603 | 6/1986 | Germany . |
| WO9323116 | 11/1993 | WIPO . |
| WO9715352 | 5/1997 | WIPO . |

*Primary Examiner*—Gary C. Hoge

*Attorney, Agent, or Firm*—Brown, Martin, Haller & McClain

[57] ABSTRACT

A Fire Fighting System includes a vehicle with a plurality of mounted motors, a fire shield system, an emergency fire retardant discharge system, and a modular instrumentation assembly. The motors are equipped with a plurality of swinging cutting elements and severe duty fire whips. The fire shield system may include a series of flame and heat retardant coverings placed on all exposed parts of the system to prevent damage from exposure to extreme heat. The emergency fire retardant discharge system distributes chemical fire retardant in the event the fire comes too close to the system. The modular instrumentation system includes a series of video, radar, and infrared sensors which provide information of the fire environment to the operator of the system. In operation, the vehicle operator positions the system at the edge of a fire line and energizes the motors causing the cutting blade assembly and fire whips to begin rotating. Once they are rotating at full speed, the vehicle is advanced along the fire line with the cutting elements cutting and slashing the burning vegetation. Once cut, the burning vegetation is thrown aside by the severe-duty fire whips that rotate to throw the debris back towards the fire. Further, post-combustion air is blown at the burning debris to assist in extinguishing the fire and direct the debris out of the path of the system. Thus, as the Fire Fighting System advances along the fire line, a fire break is created which is devoid of any combustible material.

18 Claims, 11 Drawing Sheets

352
392
400
386
348
382
372
378
380
376
338
340
374
384
388
390
24
440
454
442
448
452
450
312
456
458
446
444

VEHICLE MOUNTED FIRE FIGHTING SYSTEM

CROSS-REFERENCES TO RELATED APPLICATIONS

This application is a Continuation-In-Part of application Ser. No. 08/308,981 which was filed on Sep. 20, 1994.

FIELD OF THE INVENTION

This invention relates generally to a system and method for fighting fires. More specifically, the present invention pertains to a system and method of fighting fires which removes the fire's fuel source, thereby stopping the advance of the fire.

BACKGROUND OF THE INVENTION

It is well-known that brush land fires, timber fires and urban wild fires destroy vast tracts of land and property every year in the United States and around the world. The vast and uncontrolled nature of the destruction is in part due to the fact that fire fighting techniques have not improved in many years, the sole exception being air attack fire fighting, which consists of nothing more than dumping water and fire retardant upon the fire from the air. Most forest fire fighting is still done with hand crews using fire picks and shovels. A consistent problem is that no rough terrain vehicle yet exists that can protect its operator and safely fight fire at point blank range. This problem is all the more vexing in urban areas, where steep hillside canyon rims are crowded with expensive homes. When brush fires erupt, home owners are often left to fight the fire on their own with their garden hoses until the aerial fire tankers can arrive. This is so because no fire fighting equipment presently exists that can operate in the fire environment on rough or steep terrain. This often leads to a wholesale loss of property as overtaxed fire crews are reduced to being nothing more than traffic cops evacuating residents from neighborhoods that are being abandoned to fire.

When a fire is consuming wild lands or urban areas adjacent to wild lands, the conventional method of fighting the fire is to hose the fire with water from fire hydrants or water hauling vehicles, and to bomb the fire with water or fire retardant using airplanes or helicopters, or to fight the fire on the ground using hand tools or bulldozers or earth casting type machines. Under the current practice, protection of property must become a secondary goal whenever fire conditions threaten fire crews and their apparatus. Thus, when conditions are adverse, fire fighters are reduced to the role of "defenders", falling back to pre-established firebreaks, because no equipment exists that can safely attack fire at point blank range.

In recent years, increasingly sophisticated technology has been developed in a number of industries not related to fire fighting. These technical developments, if brought to bear in a single unit, give rise to the feasibility of a novel device such as the present invention. The following references, for example, disclose a variety of such sophisticated technologies.

U.S. Pat. No. 4,852,656, issued to Banahan in 1989, entitled "Fire Extinguishing Apparatus," discloses a tractor drawn fire extinguishing apparatus having a means of removing overburden and soil adjacent to burning terrain to expose nonflammable soil. Once removed, the soil particles are pumped through a guide chute thereby directing the soil particles onto the burning areas.

U.S. Pat. No. 5,214,867, issued to Weatherly, et al, in 1993, entitled "Forest Fire Extinguishing Apparatus," discloses a tractor drawn type implement for excavating soil with disks. Once excavated, the soil is then funneled into a pile in front of a rotating fan which throws the soil in a particular direction thereby covering, and extinguishing, the fire.

U.S. Pat. No. 4,593,855, issued to Forsyth in 1986, entitled "Vehicle Mounted Fire Fighting Apparatus," discloses a small truck-mounted device for fighting fires. This truck-mounted device pumps a liquid fire-fighting chemical through spray nozzles and hoses positioned about a truck enabling the truck to be used for close-range fire suppression.

U.S. Pat. No. 5,274,924, issued to Lee in 1994, entitled "Weed, Brush, and Small Tree Cutter," discloses a weed, brush and small tree cutter attachment for an ordinary rotary power lawnmower. The attachment consists of a chainsaw-type blade projecting from the front of the mower and is driven by a sprocket mounted to the rotary mower shaft.

U.S. Pat. No. 5,313,770, issued to Smothers in 1994, entitled "Jam-Proof Rotary Weed Cutter," discloses a rotary weed cutter tool that uses a number of flexible cutting filaments rotating about an axis at high speed. These flexible cutting filaments establish a cutting plane as the device is advanced through weeds or other brush.

U.S. Pat. No. 5,161,614, issued to Wu, et al, in 1992, entitled "Apparatus And Method For Accessing The Casing Of A Burning Oil Well," discloses a heat shielded apparatus and method for accessing the casing of a burning oil well. Specifically, the apparatus includes a sled-like carriage equipped with a digging device for excavating the area around the oil well casing to extinguish the well fire by applying a well plugging device.

U.S. Pat. No. 5,202,163, issued to Uihlein, et al, in 1991, entitled "Surface Coating For Protecting A Component Against Titanium Fire And Method For Making The Surface Coating," discloses a method for coating a metal surface for protection against titanium fires. This method consists of embedding ceramic fibers in a matrix of high-temperature lacquer and aluminum powder, and applying the matrix to the metal to be protected.

U.S. Pat. No. 3,762,478, issued to Cummins in 1973, entitled "Remote Controlled Hazard-Fighting Vehicle," discloses a remote-controlled track-mounted vehicle with a movable turret. A nozzle mounted to the moveable turret is attached to a hose that leads to a source of pressurized fire-retardant fluid. Thus, by rotating the turret, a stream of the fire-retardant fluid may be directed at various locations in a fire fighting environment.

U.S. Pat. No. 5,267,763, issued to Klien in 1992, entitled "Vehicle Side Guard," discloses a protective device consisting of a light-weight material having a magnetic backing. The protective device attaches to a vehicle to prevent dings and other surface damaging contact.

U.S. Pat. No. 5,315,915, issued to Sprafke in 1993, entitled "Periscope At The Hatchway Of A Combat Vehicle," discloses a periscope at the hatchway of a combat vehicle. Specifically, the periscope comprises two sections separated by a dust brush that allows the hatch to be opened while insuring that minimal dirt interferes with the optical alignment of the periscope.

U.S. Pat. No. 5,128,803, also issued to Sprafke in 1992, entitled "Combat Vehicle With A Hatchway In Its Armored Roof And Including A System Of Periscopes," discloses a system of periscopes for a combat vehicle having an ocular lens inside the vehicle, an objective lens outside the vehicle, and an optical path extending between them.

U.S. Pat. No. 5,260,708, issued to Auterman in 1993, entitled "Three Dimensional Interferometric Synthetic Aperture Radar Terrain Mapping With Unambiguous Phase Unwrapping Employing Subset Bandwidth Processing," discloses a three dimensional interferometric synthetic aperture radar terrain mapping system which produces a terrain map from the air. As disclosed, this radar mapping system is installed on an aircraft which is flown in a repetitive pattern over the territory to mapped.

U.S. Pat. No. 3,831,173, issued to Lerner, et al, in 1974, entitled "Ground Radar System," discloses a system to locate underground objects from a moving vehicle.

U.S. Pat. No. 5,032,841, issued to Shulenberger in 1991, entitled "Method And Apparatus For Ground Radar Information Display System," discloses a new use for existing air traffic control radar signals. Specifically, raw data from the existing Air Traffic Control Radar Beacon System is processed and displayed to show positional information for commercial and general aviation purposes.

U.S. Pat. No. 3,762,479, issued to Fike, et al, in 1973, entitled "Remotely Actuatable Portable Fire Suppression Apparatus," discloses a remotely activated portable fire suppression apparatus for use in a relatively confined area. Such areas would include engine compartments and restaurant ventilation hoods.

The preceding fire fighting devices are not specifically designed to traverse rough terrain to engage and destroy wild fire in the fire environment. The preceding radar devices are not specifically designed for use in guiding a fire-fighting vehicle over rough terrain in a fire environment by use of a three-dimensional topographical computer monitor display. The preceding automatic fire suppression apparatus is not specifically designed for highly localized all-direction massive discharge of fire retardant for suppression of fire in catastrophic fire conditions.

As a result of the above, it is a general object of the present invention to provide a Fire Fighting System having directionally controlled reversible rotary cutting elements, paddles, and fire whips designed for severe duty.

These rotary cutting elements are mounted individually, or as in the preferred embodiment, in a gang and shall be adaptable for mounting to a highly mobile track excavator or other vehicle that can be used to engage fire and to destroy fire and combustible material, such as trees and brush.

It is another object of the present invention to provide a Fire Fighting System having the ability to toss the combustible material aside and cover it with earth by engaging the rotating cutting elements, fire whips, and paddles with the soil.

It is also an object and advantage of the present invention to provide a Fire Fighting System having a system of vehicle cabin enhancements. These cabin enhancements could include fire barrier shields, heat-proof glass, cabin climate control and sensory systems, thereby allowing the operator of the System to operate safely within the fire environment, and to provide the operator with information regarding exterior terrain and ground conditions so that operations can be maintained in the fire environment.

It is another object and an advantage of the present invention to provide a Fire Fighting System having a non-combustible fire barrier shield system for an excavator or vehicle. This system of fire shields can be generally detachable by use of fastening devices so that the excavator or vehicle can be returned to other use when not fighting fires.

It is yet another object and advantage of the present invention to provide a Fire Fighting System where the non-combustible fire barrier shield system employ cementous or other fire-stop material which, in the form used and under the conditions anticipated, will not ignite, burn, support combustion or release flammable vapors when subjected to fire or heat.

It is still another object and an advantage of the present invention to provide a Fire Fighting System having a vehicle cabin with telescope-mounted video, forward-looking ground radar and GPS/GIS topographical information map and infrared video. Such instrumentation allows the operator of the vehicle to be constantly aware of ground conditions and vehicle location relative to the proximity of a fire and other surroundings when smoke obscures normal vision.

It is also an object of the present invention to provide a Fire Fighting System, mountable on an excavator or other vehicle, with ground sensing capabilities and a training wheel having a float valve to assist the operator in use of the Fire Fighting System.

It is yet another object to the present invention to provide a Fire Fighting System mountable on an excavator, or other vehicle, with a tree cutting shear which, when employed in combination with the training wheel, can safely cut and push over a tree, thereby removing the tree from the path of the advancing Fire Fighting System.

It is another object and advantage of the present invention to provide Fire Fighting System that can be operated remotely in some configurations.

It is still another object of the present invention to provide a Fire Fighting System of the present invention which is safe and easy to use, relatively easy to manufacture, and comparatively cost effective.

SUMMARY OF THE INVENTION

In an exemplary embodiment, the system of the present invention includes a fire fighting assembly attached to the boom of a construction excavator. Specifically, this fire fighting assembly is attached to the bucket hinge on the end of the excavator crowd, and is positionable using the existing bucket ram.

The fire fighting assembly includes a tee bar root, tee bar head, and tee bar arms. Specifically, the tee bar root extends from the excavator crowd and terminates into the tee bar head. This tee bar head is perpendicular to the tee bar root and has a hinge at each end. A tee bar arm attaches to each of these hinges and extends from the tee bar head to form a continuous bar perpendicular from the tee bar root.

At a number of positions along the tee bar head and tee bar arms, a reversible hydraulic motor is mounted to face away from the excavator. A rotatable fire destruction device is mounted to the rotating shaft of each of these hydraulic motors and includes various cutting element teeth, paddle teeth, and severe duty fire whips. Thus, when the hydraulic motor is engaged, the various teeth and whips rotate to strike, cut, and direct burning debris away from the excavator and back towards the fire.

Mounted beneath the tee bar head is a pair of training wheels that roll along the ground. These training wheels are positioned to support the weight of the tee bar head, hydraulic motors, and rotatable fire destruction devices, thereby insuring that the tee bar is maintained at a particular height. In order to assist the operator in maintaining the tee bar at a particular height, a pressure-sensitive float valve and radar ground sensor may be mounted on the tee bar. By maintaining the tee bar at a consistent height, the rotating whips and teeth do not strike the ground with sufficient force to stop or slow their rotation.

A number of other safety incorporated into the exemplary incorporated into the exemplary embodiment of the present invention. More specifically, an instrumentation suite is installed in the excavator. This instrumentation suite includes a periscope that is located on the construction excavator and is equipped with a standard video camera, infrared video camera, global positioning system (GPS) receiver, a radar transmitter/receiver, compass, and temperature sensors, with the outputs of all of these being displayed on monitors viewable by the operator of the excavator.

In addition to the instrumentation elements, an emergency fire discharge unit is mounted on the excavator and, when activated, discharges fire retardant in all directions from the excavator. Such discharge will inhibit the approach of any fire towards the excavator thereby enabling the operator of the excavator to maneuver it to safety.

Operation of the preferred embodiment includes positioning of the excavator equipped with the tee bar and rotating cutting devices at one end of a fire line. Then, using the instrumentation devices, the operator advances the excavator along the fire line and engages the rotating cutting devices in a direction to flip debris towards the fire. As the cutting devices strike and cut shrubs, brush, and small trees, the debris is flipped back into the fire. Thus, as the excavator advances along the fire line, a wide fire-break is cut, thereby preventing the spread of the fire beyond the fire-break.

In addition to removing trees using the rotating cutting devices, unwanted trees may also be removed with the tree shear. The tree shear is mounted under the tee bar and is positioned such that in the event there is a tree too large to be removed by the rotating teeth and whips, the tree shear may be employed to simply shear off the tree and set it out of the path of the excavator.

In an alternative embodiment of the present invention, the tee bar assembly is modified to incorporate a swinging cutting blade assembly. The swinging cutting blade assembly includes a blade support which is formed with a number of blade brackets. Within each of these blade brackets, a swinging cutting blade is inserted and held in place by a retaining pin. As a result, the cutting blade swings freely about the retaining pin, so that the cutting blade may rotate backwards when striking an object which is too large to cut with the first contact.

Additionally, the alternative embodiment of the present invention includes a tee bar support assembly which has a pair of leaf springs oriented to support the weight of the tee bar assembly. Underneath the support assembly, a pair of casters are positioned to allow movement of the tee bar assembly in any direction. In order to provide the casters with some tolerance for obstacles, each caster is held in its forward position by a spring strut and associated spring. Thus, if the caster hits an obstacle too larger to roll over, the spring compresses to allow the caster to travel rearwards until the obstacle is passed. At that time, the spring returns the caster to its original position.

Also in the alternative embodiment, the tee bar is equipped with a series of air tubes and nozzles. These air tubes and nozzles are attached to a post-combustion air source, such as the exhaust system of the vehicle. This air is compressed and forced through the air tubes and out the nozzles. The nozzles are directed such that the forced air assists in clearing the fire break by blowing the debris and embers back into the fire.

The alternative embodiment includes an instrumentation assembly which is easily mounted to the construction excavator. This assembly includes a heat-treated window surrounded with a frame which is sized to fit the front opening of an excavator cabin. On the instrumentation assembly, a number of monitors and video displays are positioned such that the operator of the Fire Fighting System may view any instrument, while simultaneously viewing the fire environment. Additionally, all other instrumentation may be mounted to the instrumentation assembly to provide a quick installation onto a construction excavator.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DESCRIPTION OF A PREFERRED EMBODIMENT

Figures 1, 2:
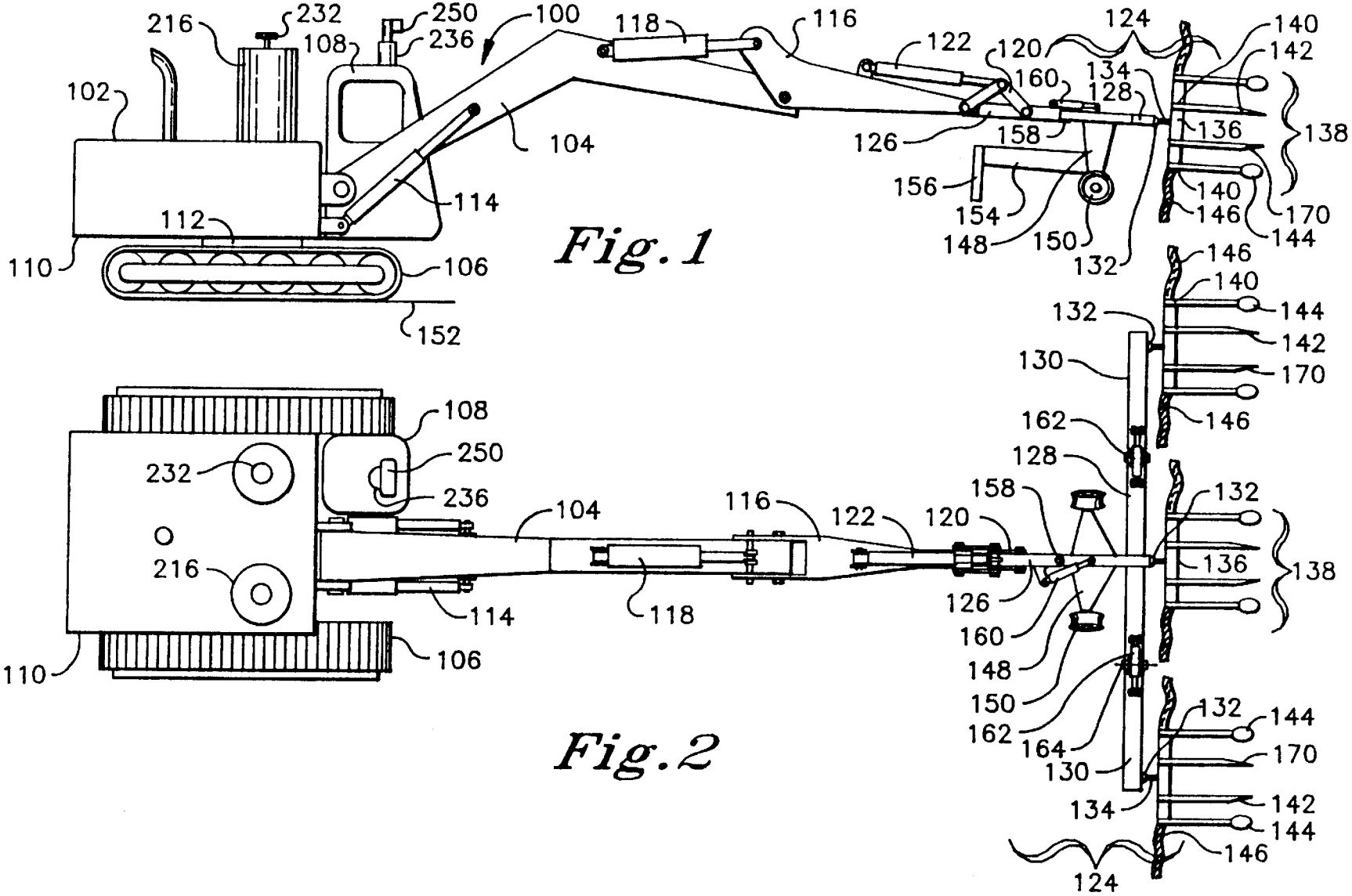
FIG. 1 is a side view of the system of the present invention, showing a construction excavator configured to fight fires.
FIG. 2 is a plan view of the system of the present invention, showing the cutting element orientation and tee arms, tee bar and tee bar head.

As illustrated in FIG. 1, the Fire Fighting System of the present invention is shown and generally designated 100. The system of the present invention as shown includes a construction excavator 102. It is to be appreciated, however, that the system of the present invention could be mounted on a variety of other vehicles. Such vehicles could include, for example, bulldozers, tractors, fire trucks, or heavy duty utility vehicles. In fact, such vehicles could have tracts or wheels, or could even include a manually pushed platform. Additionally, the vehicle could be controlled manually or via remote-control.

The excavator is a commonly used heavy construction vehicle which is well known for its versatility and strength. As shown in FIG. 1, the construction excavator 102 is well-suited for use in the system because of its ability to extend its boom 104 well in front of the vehicle. Moreover, the excavator has a rugged track propulsion system 106 which is ideal for use in low traction environments, such as brush-covered hillsides and forests. In order to fully discuss the system 100 incorporating an excavator, the various components of an excavator 102 will be discussed generally.

The main body of the excavator 102 includes an operator cabin 108 and an engine compartment 110 that are mounted to an undercarriage 112 that rotates on a pair of tracks 106. These tracks 106 are independently controlled, thereby enabling the movement and turning of the excavator 102 by energizing either one or both of the tracks 106. The excavator operator sits in the cabin 108 facing away from the excavator 102, giving the operator an unobstructed view of the surroundings and work area. The main boom 104 is extendable from the front of the excavator 102 and is articulable by one or more hydraulically activated boom rams 114. A crowd 116 hinges from the end of the boom 104 and is articulable using the hydraulically activated crowd ram 118. At the end of the crowd 116, a bucket hinge 120 is mounted and moveable with a bucket ram 122. Attached to the crowd 116 and bucket hinge 120 is the tee arm assembly 124 of the present invention. From this Fig., and with reference to FIG. 4, it is appreciated that the boom 104, crowd 116, and bucket hinge 120 may be simultaneously articulated in order to position the tee arm assembly 124 in virtually any particular orientation or position.

The tee bar assembly 124 extends form the crowd 116 and includes a tee bar 126 which terminates at the tee bar head 128. Attached to the tee bar head 128, and extending perpendicularly from the tee bar 126, are a pair of tee arms 130 (shown more clearly in FIG. 2). Three reversible rotary mechanisms 132, such as motors, are mounted to the tee arms 130 and tee bar head 128. The motors 132 used in the present invention are hydraulically driven. It should be noted, however, that electric or pneumatic motors are equally effective and could be used. While a number of rotary mechanisms are shown as motors, it is to be appreciated that any method of causing rotation is acceptable. Another method, for instance, could include a mechanical take-off from the vehicle's powertrain, or a single motor or power drive mechanically linked to a variety of rotary mechanism locations. Additionally, it should be appreciated that while the present embodiment is shown with three or four motors 132, any number could be used. Each reversible motor 132 has a rotary shaft 134 that extends forward from the tee bar head 128 or tee arm 130. Attached to each rotary shaft 134 is a cutting device 136 having a number of cutting elements 138 with integral tooth sockets 140, cutting element teeth 142, paddle teeth 144, and severe duty fire whips 146.

The tee bar 126 and tee arms 130 are supported by a training wheel assembly 148 and a pair of training wheels 150. The length of the training wheel assembly 148 ensures that the tee bar 126 is maintained a certain height from the ground. By insuring that the tee bar is a certain distance above the ground 152, the clearance required for the cutting device 136 is maintained. More specifically, by maintaining a certain clearance for the cutting devices 136, the cutting element teeth 142, paddle teeth 144, and severe duty fire whips 146 are allowed to rotate without hitting the ground 152. In addition to maintaining the height of the tee bar 126, the training wheel assembly 148 also supports the tree shear attachment 154 and tree shear 156. The details of the tree shear attachment 154 and the tree shear 156 will be more fully shown and discussed in connection with FIGS. 3 and 4.

Referring now to FIG. 2, the various features of the tee bar assembly 124 are shown in more detail. As discussed above in connection with FIG. 1, the tee bar 126 extends from the bucket hinge 120 attached to the end of the crowd 116 to the tee bar head 128 and is moveable using the bucket ram 122. Midway between the end of the crowd 116 and the tee bar head 128 is a tee bar hinge 158. This tee bar hinge 158 facilitates the movement of the tee bar head 128 and tee arms 130 away from a perpendicular relationship to the tee bar 126. The movement is facilitated with the tee bar ram 160 which allows the operator of the system to hydraulically articulate the tee bar hinge 158 in a side-to-side direction. Such articulation is particularly useful when the excavator 102 is unable to attack the fire line by traveling along the line. The tee bar hinge 158 allows the operator of the system to swing the boom 104 away from the direction of travel, yet articulate the tee bar head 128 and tee arms 130 such that the cutting elements 138 can attack a fire line parallel to the path of the vehicle. As a result, the system may be used at a distance from the fire line, while creating an effective fire break. Also, the ability to position the tee bar 126 away from the path of travel facilitates the creation of fire breaks on terrain too rough for the vehicle, such as steep embankments.

Focusing now on the tee bar head 128 and tee arms 130, the positioning of the three cutting devices 136 is clear. It should be appreciated that, given the placement and diameter of the cutting devices 136, nearly every inch of brush along the tee bar head 128 and tee arms 130 will be exposed to one of the three cutting elements 138.

Figure 3:
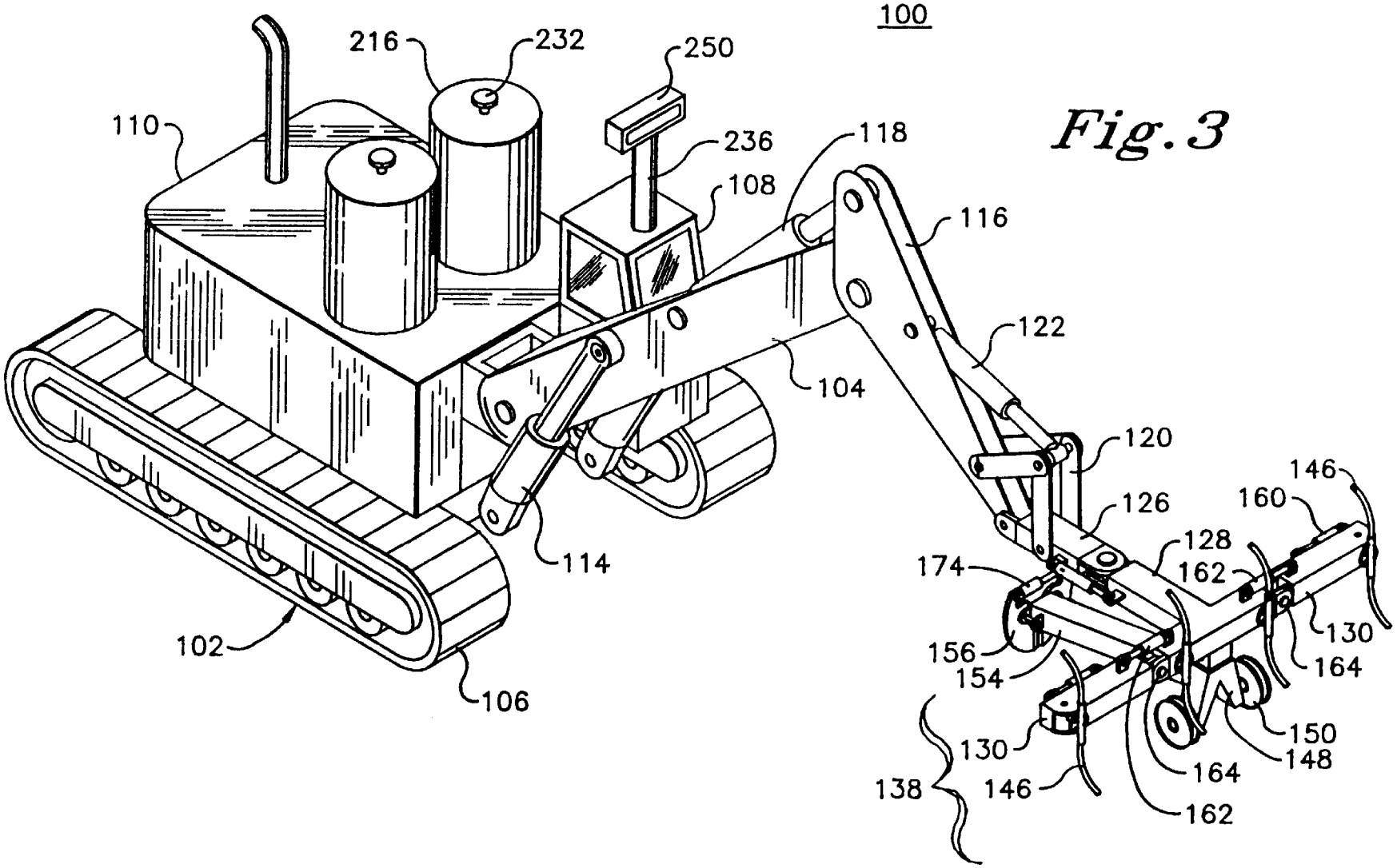
FIG. 3 is a perspective view of the system of the present invention, showing the various component parts of the tee bar and tree shear attachment.

Referring now to FIG. 3, the system 100 of the present invention, including a construction excavator 102, is shown in perspective. From this view, certain aspects of the tee bar head 128 and tee arms 130 are apparent. Specifically, the tee arm rams 160 are shown attached to both the tee bar head 128 and the tee arm 130 and span the tee arm hinge 162. By activating these two tee arm rams 160, the two tee arms 130 articulate downwards at the tee arm hinges 164 to effectively shorten the horizontal length of the tee bar head 128 and tee arms 130. This shortening facilitates the transport of the system 100 by narrowing the distance required for a transport vehicle. In other words, because the tee bar head 128 and tee arms 130 are bent instead of straight, the system of the present invention may be transported using a slightly over-sized trailer.

Referring generally to FIGS. 2 and 3, the cutting elements 138 are shown extending from the tee bar head 128 and tee arms 130. These cutting elements 138 include tooth sockets 140, cutting teeth 142, severe duty fire whips 146, and paddle teeth 144. The tooth sockets 140 are located on a cylindrical housing 166 which is attached to the motor shaft 134 to project forward from the tee bar head 128 and tee arms 130. Each tooth socket 140 is sized to receive either a cutting element tooth 142 or a paddle tooth 144. Once inserted into the socket 140, the combination of cutting elements 142 and paddle teeth 144 may be rotated by actuating the motor 132.

The cutting teeth 142 are elongated cutting instruments that have a shaft 168 having one end that is insertable into the tooth sockets 140, and the opposite end sharpened to a cutting edge 170. Because the cutting edge 170 is sharpened, when the cylindrical housing 166 is rotated, the cutting edge 170 will strike and cut any debris or vegetation in its path. Similarly, the paddle teeth 144 are also elongated instruments having a shaft 168 that is insertable into the tooth sockets 140. These paddle teeth 144, however, are equipped with a broad digging paddle 172 that is designed to scoop and throw dirt and debris when rotated to strike the ground. Each of the cutting teeth 142 and paddle teeth 144 is made of a hardened steel or carbide-tipped steel. It should be appreciated, however, that any material having similar hardness and strength could be used as long as a cutting edge can be reliably formed.

In addition to the cutting elements 138, at least one severe duty fire whip 146 is mounted to each motor 132. This mounting is achieved by attaching the fire whip 146 to the cylindrical housing 166. The fire whip 146 extends out past the cylindrical housing 166 such that the fire whip will swing freely of the cutting elements 138 when the motor is engaged. These severe duty fire whips 146 may be made of any sturdy free-swinging material. Such materials, for example, include wire rope, steel cable, or chain.

Also shown in FIG. 3, the training wheel assembly 148 extends downwards from the tee bar 126, forming a tripod structure when mounted on an excavator 102. It is to be appreciated that due to the rigid nature of the training wheel assembly 148, the tee bar head 128 and tee arms 130 will remain at a constant elevation despite the loads that are present on the bars. The training wheels 150 are mounted to the training wheel assembly 148 at an angle. This is so to insure that the training wheels 150 engage the soil in such a manner so as to provide directional control for the tee bar 126 and cutting elements 138. This directional control will, perhaps, be most important in environments where there is severe smoke that prohibits the operator of the system 100 from visualizing the path of the tee bar 128 and cutting elements. As an alternative to the training wheels 150, a pair of skids (not shown) may be used. Skids would function like the training wheels 150 to engage the soil to assist in the directional control of the system. To aid in such control, the skids may be placed at an angle to improve their traction on the soil. More specifically, by placing the skids on their edge, the skid will cut into the soil and provide improved directional control.

The training wheel assembly 148 can also be equipped with a float valve and ground sensor radar (not shown). The combination of these two devices, as mounted on the tee bar head 128, assist in the hydraulic control of the excavator 102 to help maintain contact of the training wheels 150 to the ground 152. In fact, by activating the float valve, the system operator is relieved of the arduous task of ensuring that the severe duty fire whips 146 strike the ground. Such assistance is particularly useful when fighting fires in environments where the terrain is rough.

Attached to the training wheel assembly 150 is the tree shear attachment arm 154 and associated tree shear 156. From this Fig., the mechanical components of the tree shear 156 are readily seen. The tree shear 156 is movably attached to the end of the tree shear attachment arm 154 and articulable using a tree shear ram 174. As appreciated from this view, when the tree shear ram 174 is activated, the tree shear blades 176 are forced together, thereby pinching and cutting anything that is present between the two shear blades 176.

Figures 4, 14:
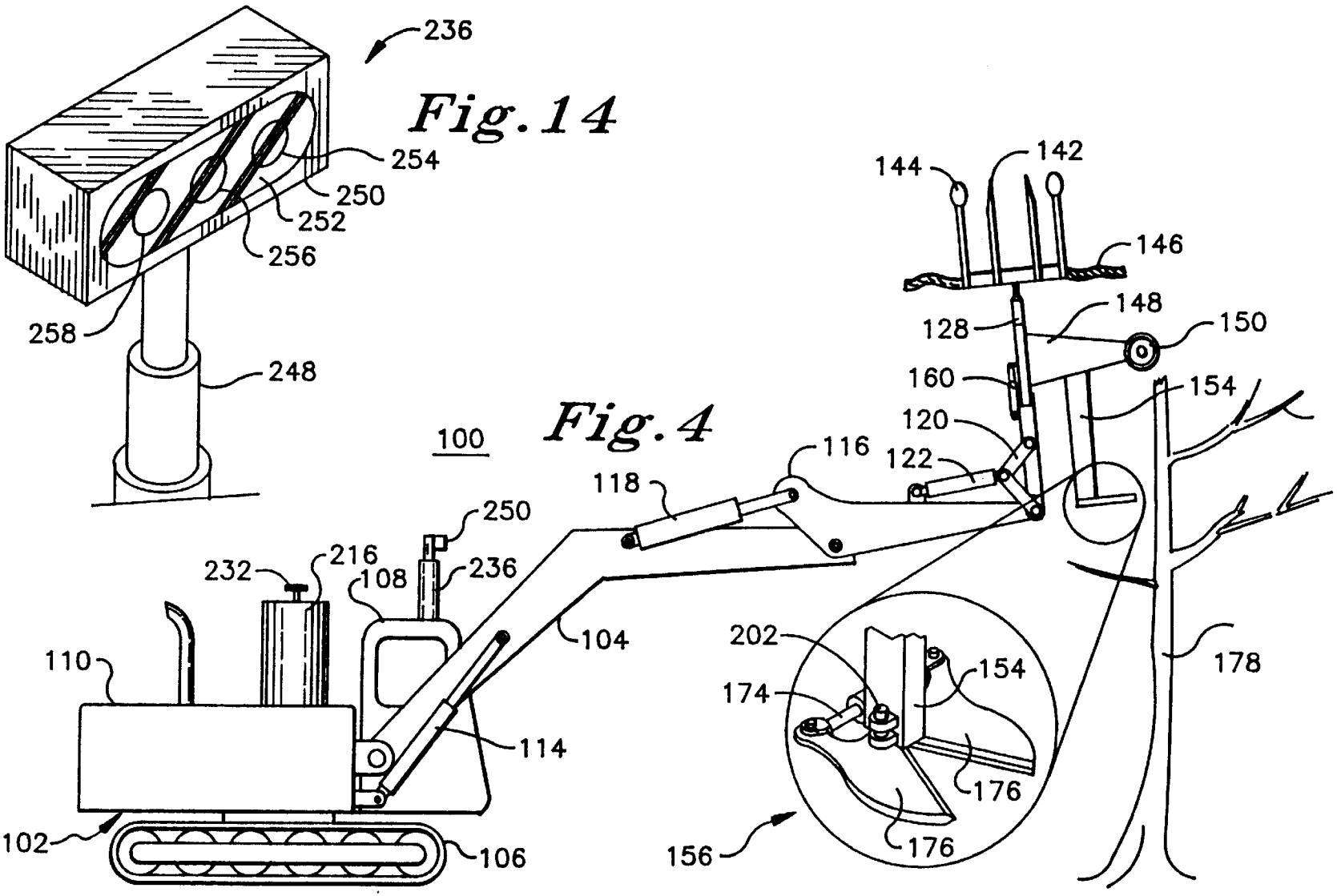
FIG. 4 is a side view of the system of the present invention, showing the orientation of the tee bar during use of the tree shear attachment.
FIG. 14 is a perspective view of the periscope showing some of the various instrumentation and communication devices of the Fire Fighting System of the present invention.

Referring now to FIG. 4, the system 100 of the present invention is shown with the tree shear 156 in the process of removing an unwanted tree 178. By articulating the bucket ram 122, the tee bar 126 is moved to a vertical position with the motors 132 pointing upwards. In this position, the training wheel assembly 148 is placed against the trunk of the tree with the training wheels 150 on opposite sides of the trunk. As the training wheel assembly 148 is advanced over the trunk of the tree 178, the tree shear blades 176 are also advanced around the trunk. Once the tree shear blades 176 are positioned on each side of the trunk, the tree shear ram 174 is activated, thereby severing the trunk and allowing the system to simply push the tree 178 out of the way.

FIG. 4 also shows how the cutting elements 138 can be used to remove burning debris from areas other than those directly in front of the system 100. More specifically, because of the reaching ability of the boom 104, crowd 116 and tee bar assembly 124, a variety of surfaces and debris may be cleared. For example, in the event that the lower branches of a tree are burning, the cutting elements could be positioned to destroy only those lower branches that are affected by fire. This would allow the destruction of the fire, while minimizing the damage caused by the fire to surrounding vegetation. In accordance with the application of the system to low lying branches, the cutting elements could be used to remove burning debris from other structures as well. For example, burning shingles could be scraped or otherwise removed from the roof of an otherwise unaffected structure with great precision, thereby saving the structure from otherwise certain loss. In addition to the fire fighting capabilities listed above, the ability to control the positioning of the cutting elements 138 and severe duty fire whips 146 uniquely suit the system 100 for other applications, including the removal of paint and plaster from ships and buildings.

Figure 5:
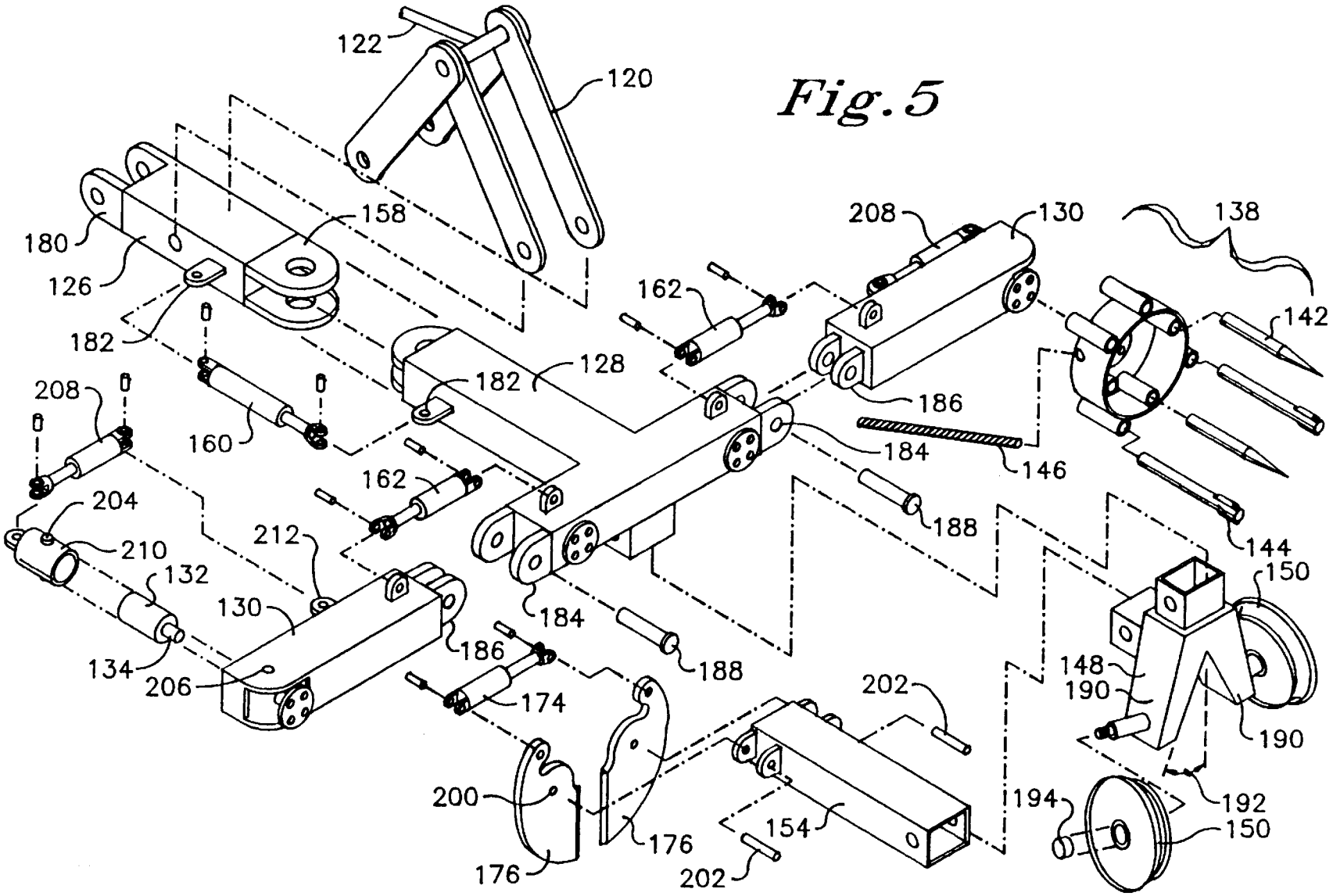
FIG. 5 is a detailed view of the tee bar assembly showing the component parts of the tee bar, and their mechanical interaction.

Referring now to FIG. 5, the various components of the tee bar, tee bar head, and tee arms are shown in exploded detail. As shown, the base of the tee bar 126 is equipped with a pair of hinge plates 180 that are aligned with the end of the crowd 116 and secured with a pin (not shown). The bucket hinge 120 is attached to the tee bar 126 slightly forward of the hinge plates 180 and secured in place with a bucket hinge pin (not shown). This pin securely attaches the bucket hinge to the tee bar, yet allows for movement of the bucket hinge about the pin.

The tee bar hinge 158 is located midway between the tee bar hinge plates 180 and the tee bar head 128. As discussed above, the tee bar hinge 158 allows the tee bar head 128 to be articulated from side-to-side by actuating the tee bar ram 160. This tee bar ram 160 is attached to the tee bar 126 using a pair of tee bar ram mounting brackets 182.

The tee bar head 128 has two sets of tee bar head hinge plates 184 at each end of the tee bar head 128. These tee bar hinge plates 184 are positioned to align with tee arm hinge plates 186 located on the end of the tee arms 130 and the two sets of hinge plates 184,186 may be attached using a tee arm hinge pin 188. The tee arm hinge pin 188 allows the tee arms 130 to be angled downwards from the tee bar head 128 by actuating the tee arm ram 162. This movement, as mentioned above, shortens the horizontal width of the tee bar head 128 and tee arms 130 so that the system of the present invention can be transported using trailers having standard widths.

Figure 6:
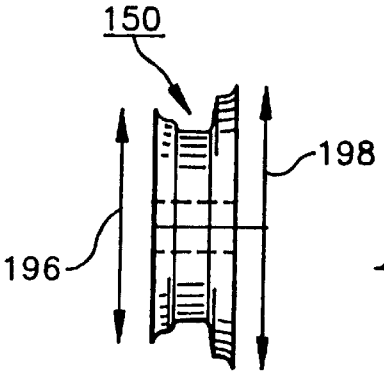
FIG. 6 is a detail view of the training wheel taken along line 6—6 of FIG. 5.

Mounted to the underside of the tee bar head 128 is the training wheel assembly 148. The training wheel assembly 148 is formed with each leg 190 pointing outwards at an angle 192 not perpendicular to the ground. This angle 192 serves two functions. First, the angle of the training wheel leg insures that the training wheel 150, secured to the leg 190 with a training wheel nut 194, will strike the ground at an angle. As a result, at least one edge of the training wheel strikes the ground with such force that the edge creates a groove which aids in guiding the training wheels 150 and the tee bar 126. Referring briefly to FIG. 6, the training wheel 150 is shown having two different diameter edges, commonly referred to as "boss edges". In other words, the diameter 196 of one side of the training wheel 150 is different than the diameter 198 of the other side of the training wheel 150. This is so because two groove-forming edges are better than one and, as a result, provide better directional stability. It is to be appreciated that the skids discussed above could be attached to the training wheel assembly 148 and would provide similar directional stability.

A second function of the angle 192 between the training wheel legs 190 is to provide the angular crevice to assist in the shearing and pushing over of unwanted trees as discussed above in connection with FIG. 4. Although the angle between the training wheel legs is not critical, it is preferred that there be sufficient distance between the training wheels 150 to allow a tree of substantial size to pass between them and into the crevice.

Referring back to FIG. 5, the tree shear attachment 154 is shown extending out the back of the training wheel assembly 148. From this view, the manner in which the tree shearing blades 176 are mounted to the tree shear attachment 154 is clearly appreciable. Each tree shear blade 176 has a mounting socket 200 that is sized to slide over a mounting pin 202 formed on the end of the tree shear attachment 154. Each tree shear blade 176 is attached to an end of the tree shear ram 174 that pushes the ends of the tree shear blades 176 apart when actuated, thereby forcing the opposite ends of the tree shear blades 176 together. This allows the tree shear blades 176 to sever the trunk of a tree by positioning the blades on either side of the trunk and actuating the tree shear ram.

As shown in FIG. 5, the tee bar head 128 and tee arms 130 are equipped with four motors 132. It is to be appreciated, however, that any number of hydraulic motors 132 could be used in combination on the present invention. Each hydraulic motor 132 is mounted within either the tee arm 130 or the tee bar head 128, and secured in place with a pair of pivot pins 204. These pivot pins 204 engage into pivot holes 206 and allow the hydraulic motor 132 to rotate about the pivot pin. This rotation provides some directional control of the motor shaft 134 in order to sweep the cutting elements 138 horizontally from side-to-side. Such side-to-side movement will enhance the cutting ability of the cutting elements 138, as well as improve the dirt and debris throwing capabilities of the paddle teeth 144 and severe duty fire whips 146. Each hydraulic motor 132 is equipped with a motor ram 208 which is attached at one end to the rear of the motor housing 210, and at the other to a motor ram bracket 212 mounted to the wall of the tee arm 130 or tee bar head 128. By actuating the motor ram 208, the motor shaft 134 may be directed in a side-to-side manner.

Figure 7:
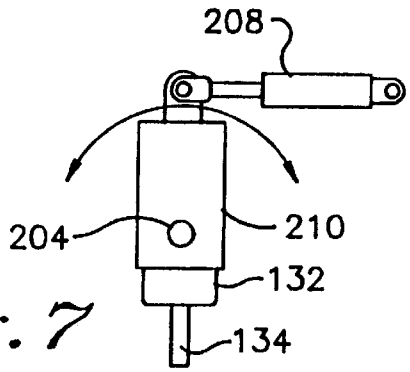
FIG. 7 is a detail view of the hydraulic motor, pivot pins, and motor ram taken along line 7—7 of FIG. 5.

FIG. 7 shows the detailed interaction of the hydraulic motor 132, motor pivot pin 204, and motor ram 208. From this view it is to be appreciated that once the pivot pin 204 is inserted into the pivot hole 206, the direction of the motor shaft 134 may be controlled by activation of the motor ram 208. It should be noted, however, that there is a practical limitation to the degree of rotation achievable by the motor ram 208. Specifically, because the motor shaft 134 extends out from the tee bar head 128 or tee arm 130 by its shaft length, the cutting elements 138 mounted to the cylindrical housing 166 at the end of the shaft 134 must not be positioned where they could strike the tee bars 126 themselves. As a result, the motor ram 208 can only realize an angular sweep of approximately twenty degrees from the perpendicular.

Figure 8:
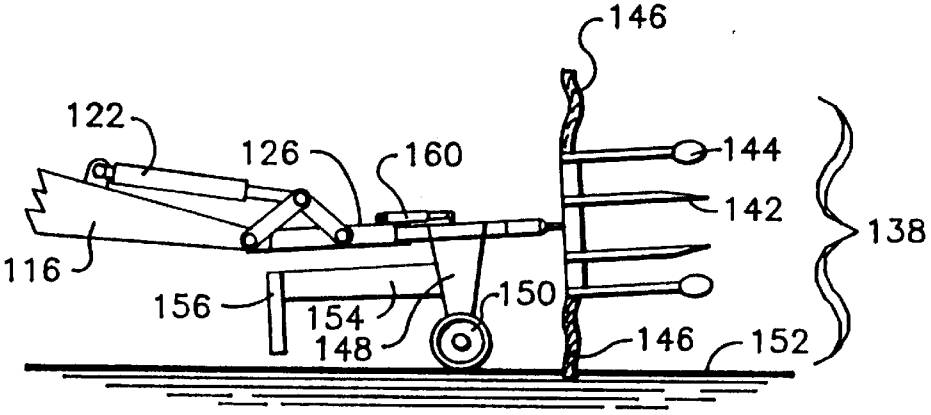
FIG. 8 is a detailed side view of the tee bar of the system of the present invention, showing the various components of the rotary cutting elements in a perpendicular orientation to the ground for brush and tree clearing.

Referring now to FIG. 8, the system of the present invention is shown in its ground sweeping and fire destruction mode. In this mode, the operator positions the tee bar 126 horizontally with the training wheels 150 on the ground. In this position, the tee bar head 128 and tee arms 130 are maintained at an optimal distance from the ground. Maintenance of this optimal distance insures that, once rotating, the severe duty fire whips 146 strike the ground 152 with sufficient force to clear away burning brush, yet do not significantly slowed of the rotation of the cutting elements. As discussed above, in order to assist the system operator in maintaining the training wheels 150 on the ground, a hydraulic float valve and ground radar system may be mounted to the training wheel assembly 148. Such a float valve will minimize the difficulty in maintaining the proper positioning of the cutting elements 138 while operating over rough terrain. Also while in the ground sweeping and fire destruction mode, the cutting elements 138 project horizontally in front of the tee bar head 128 and tee arms 130 to destroy any burning vegetation or debris.

Figure 9:
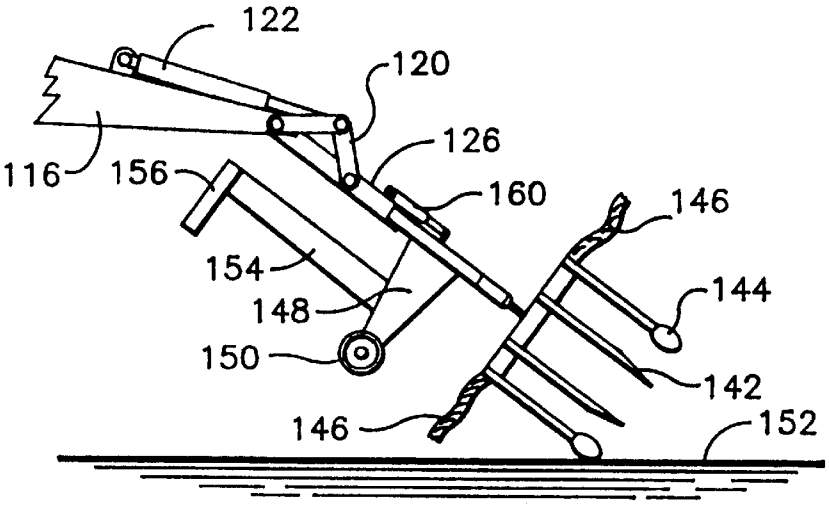
FIG. 9 is a detailed side view of the tee bar of the system of the present invention as in FIG. 6, with the tee arm at an acute angle to the ground for throwing dirt with the rotating paddle tooth blades.

Referring now to FIG. 9, the system of the present invention is shown in its dirt-throwing mode. In this mode, the operator of the excavator positions the tee bar 126 at an angle to the ground 152 such that the training wheels 150 are not resting on the ground 152. This position allows the paddle teeth 144 to strike the ground 152 and project dirt to one side of the system 100. This dirt projection is particularly useful for burying burning materials with earth in order to extinguish a fire.

Figure 10:
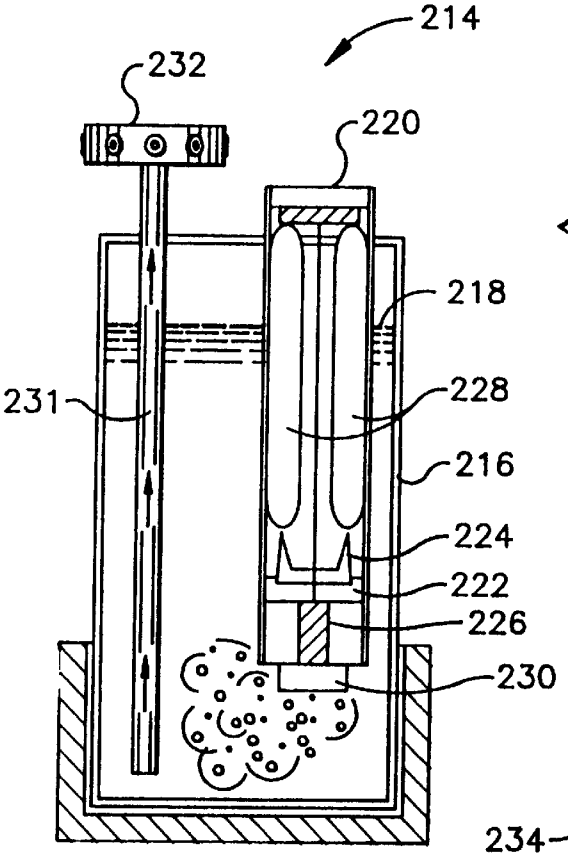
FIG. 10 is a cross-sectional view of the emergency fire retardant discharge unit.

Referring now to FIG. 10, the emergency fire retardant discharge unit 214 is shown in cross-section. The emergency fire retardant discharge unit 214 includes a cylindrical chamber 216 having an approximate volume of 45 gallons that is filled with fire retardant chemicals 218. A heat sensitive obturator 220 is mounted to the top of the chamber 216 to monitor the temperature of the surrounding area. In the event the outside temperature is higher than a preset safety temperature, the emergency fire retardant discharge unit 214 is activated. Such activation begins when a piston 222 with a pair of integral acicular, xyresic knives 224, is projected upwards by a compression spring 226 with sufficient force to puncture a pair of pressurized two-part chemical compound cylinders 228. Once punctured, the two-part chemical escapes the compound cylinders 228 and flows downwards through the cylinder port 230 to create an increase in the pressure within the chamber 216. This increased pressure forces the fire retardant chemicals 218 up through the discharge tube 231for spraying by the high volume all directional nozzle sprinkler 232. By spraying the fire retardant chemicals 218 in all directions, the safety of the system is increased. More specifically, in the event of an emergency involving exposure of the system 100 to excessive heat, the activation of the emergency fire retardant discharge unit 214 will provide the operator with an opportunity to escape the fire and maneuver the vehicle to safety.

Figure 11:
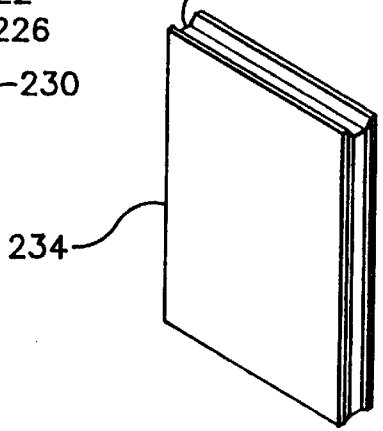
FIG. 11 is a perspective view of a typical fire shield panel.

Referring now to FIG. 11, a typical fire shield panel 234 is shown in perspective. This fire shield 234 consists of a multi-layer, heat-resistant material that insulates the system from the heat. Such materials may include a cementous fire-stop material, or a flexible fire-proof cloth. Applying the fire shield panels to the preferred embodiment requires that a large number of panels 234 be sized and shaped to cover virtually every exposed surface of the system 100 including the construction excavator 102. Such surfaces would include, for example, the tee bar 126, tee arms 130, boom 104, crowd 116, engine compartment 110, periscope 236, tree shear attachment 154, and all other exposed surfaces of the system 100. It should be appreciated, however, that it would be difficult to fully shield the boom ram 114, crowd ram 118, and bucket ram 122 using a rigid fire shield panel 234. As a result, some of the fire shield panels 234 may be made of a soft, pliable material that would allow some degree of flexibility for covering moving parts. As a result, the fire shield panels 234 may be reinforced with a tensile fiber or wire mesh that would combine a high level of strength with a high temperature tolerance.

Suitable attachment means may be used to attach the fire shield to the exposed surfaces. Such means may include, for example, magnets or clamp fasteners. It should be noted, however, that any relatively secure, yet removable manner of attaching the fire shields could be used. Such removability would insure that the vehicle, once away from the fire fighting environment, could be returned to its original capacity simply by removing the fire shields 234.

Figure 12:
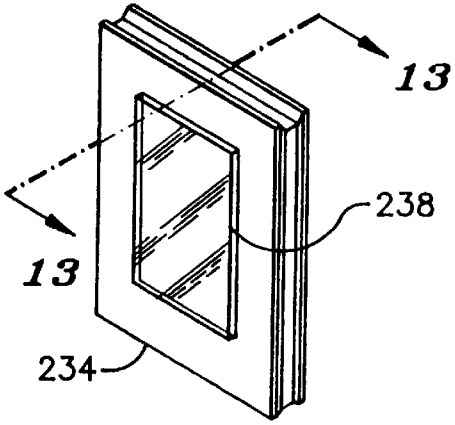
FIG. 12 is a perspective view of a typical fire shield panel having a heat resistant window.

Referring to FIG. 12, a typical fire shield 234 having a window 238 is shown. The window 238 is formed from a dual-glazed heat-resistant glass that is capable of withstanding extreme heat. In addition, the glass may be coated with a heat resistant coating for added heat tolerance. With such heat-resistance, the fire shield panels 234 with windows 238 can replace the existing windows of the construction excavator 102, thereby allowing the excavator to be exposed to heat far in excess of what an un-equipped excavator could withstand. It is also to be appreciated that, while the preferred embodiment of the present invention includes a construction excavator, any number of other vehicles could be used in the system of the present invention.

Figure 13:
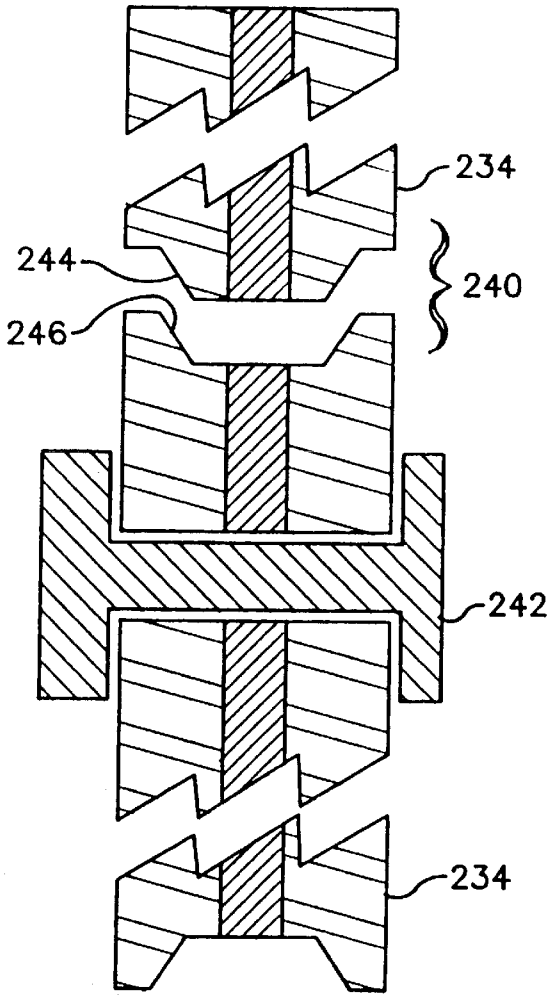
FIG. 13 is a cross sectional view of a typical fire shield panel taken along line 13—13 of FIG. 12; cross-sectional view of the fire shield panel showing the tongue-in-groove joints and the flexible "H" fire shield joint strip.

FIG. 13 is a cross-sectional view of a typical fire shield 234 showing a tongue-in-groove joint 240 between adjacent panels 234, as well as an H-shaped fire shield joint strip 242. In one embodiment, each fire shield panel 234 is formed with a tongue-shaped protrusion 244 on one side, and a groove-shaped crevice 246 on the other. Thus, when a tongue-shaped protrusion 244 of one panel is inserted into the groove-shaped crevice 246 of another panel, a resilient seal is created. This resilient seal creates a continuous heat barrier from one fire shield panel 234 to the next. In this manner, any number of fire shield panels 234 may be positioned adjacent each other to protect an area of significant size from heat damage.

In another embodiment of the fire shield, the H-shaped fire shield joint strip 242 functions much like the tongue-in-groove fire shield. Specifically, the H-shaped fire shield joint strip 242 seals two adjacent fire shield panels together, without the need for aligning tongue-in-groove edges. This is particularly useful when a typical fire shield must be cut in order to fit a peculiarly shaped component. In such circumstance, forming a tongue-shaped protrusion 244 or groove-shaped crevice 246 would be difficult.

Referring now to FIG. 14, the instrumentation periscope 236 is shown in further detail. Specifically, the periscope 236 is mounted to the top of a telescoping mast 248 that allows the periscope to be extended upwards from the roof of the excavator cabin 108. The instrumentation head 250 is preferably made from a material that withstands exposure to high temperature for an extended period of time. Importantly, the instrumentation head 250 is preferably formed with a window 252 on its front facing side that is covered with a heat shield having double-glazed, fire-resistant glass. This allows the instruments within the instrumentation head to peer outwards from the periscope 236 without being subjected to the extreme temperatures of the environment.

Mounted within the instrumentation head 250 of the periscope 236 are a number of cameras and antennae. More specifically, a video camera 254 is mounted within the instrumentation head 250 and directed through the window 252. The electronic output from the video camera 254 is routed via an electrical cable to a monitor mounted within the excavator cabin 108. Additionally, an infrared video camera 256 is mounted within the instrumentation head 250, the output of which is also routed to a monitor within the excavator cabin 108. This configuration allows the operator of the system 100 to visualize the immediate surroundings of the system with the video camera 254, as well as the area of extreme heat with the infrared camera 256, thereby enabling the operator to direct the system 100 towards the most critical areas of the fire.

In addition to the two video cameras 254, 256, the instrumentation head 250 also houses a radar transmitter/receiver and its associated boresight antennae 258. The output of the radar, like the video cameras, is routed to a video monitor in the excavator cabin 108. Also, Global Positioning System (GPS) and Geographic Information System (GIS) antennae are mounted within the instrumentation head 250. These antennae are connected to a GPS/GIS receiver which, in combination with a video monitor, provides a visual representation of the topography of the region where the system 100 is operating. Additionally, an antenna for a two-way radio is located within the instrument head 250 to provide bi-directional communication between the operator of the system 100 and other fire fighting personnel. Although the instrumentation has been discussed in conjunction with a fire environment, it is to be appreciated that such instrumentation could also be used in a variety of other environments. Other environments could include, for example, a snow storm where an operator of a vehicle could use assistance in detecting the presence of a road. In fact, the infrared video, in combination with the GPS/GIS information, could assist a rescue team in locating an avalanche victim buried under snow.

To assist the operator in managing all of the instrumentation, all electronic instrumentation signals are monitored by an onboard computer system (not shown). The computer system receives all video and GPS/GIS signals and generates composite video images on the cabin mounted computer monitor. From that image, the operator may instantly determine the local topography, fire line location, as well as the location of obstacles in the path of the system.

In order to maintain a comfortable environment for the operator of the system, a cabin climate control system equipped with an air filter is provided. Specifically, this climate control system protects the operator and instrumentation within the cabin from the extreme heat of the environment. To assist the operator in maintaining the safety of the fire fighting mission, a number of thermometers are provided that give the operator an indication of the thermal environment. Such thermometers may be placed to sense the temperature in the engine compartment 110, on the tee bar 126 or tee bar head 128, and inside the cabin 108. In fact, in order to insure that the temperature of both the engine compartment 110 and fuel storage tanks are maintained at a safe level, a dedicated fire alarm system may be attached to the temperature sensors to warn the operator of any hazardous temperatures.

OPERATION OF THE ABOVE-DESCRIBED EMBODIMENT

The operation of the above described embodiment of the present invention includes mounting the tee bar assembly on a suitable vehicle. As noted above, any suitable vehicle may be selected. The construction excavator 102, perhaps, is the best vehicle suited for heavy fire fighting duties because it has a track propulsion system and extended boom reach. Mounting of the tee bar assembly 124 includes attaching the tee bar to the bucket end of the crowd 116 and connecting it to the bucket hinge 120. This attachment method also includes connecting the hydraulic lines from the excavator 102 to the hydraulic lines of the hydraulic motors 132, tee bar ram 160, motor rams 208, tree shear ram 174, and tee arm rams 162. It is to be appreciated that a control mechanism is present in the tee bar head 128 and tee arms 130, activatable from the control console mounted within the cabin 102, which controls the operation of the various rams.

Following attachment of the tee bar assembly 124 and associated hydraulic lines, the instrumentation suite is installed on the vehicle being used. In this embodiment in which the system includes a construction excavator 102, the periscope 236 is mounted to the top of the excavator cabin 102, and the electrical control and signal cables are routed into the cabin. More specifically, the electrical signal wires that transmit the electrical signals from the video camera 254, infrared video camera 256, radar 258, GPS/GIS 260, and two way radio 262 are routed down the periscope 236 and inside the cabin. Inside the cabin, the control cables are attached to a periscope control device that enables the system operator to rotate the periscope for 360 degree viewing. Also inside the cabin 102, the signal cables from the video camera 254 and infrared video camera 256 are attached to a pair of video monitors that enable the operator to view both the true video image of the surroundings, as well as the infrared image of the surroundings showing areas of higher and lower heat. Additionally, the radar transmit and receive signals are connected to a radar system which displays a radar image of the fire fighting area on a monitor also within the excavator cabin. Further, the GPS/GIS antenna cable is attached to a GPS receiver that provides a video display identifying the topographical area of the fire fighting environment. Finally, the two-way radio equipment that is mounted within the cabin is attached to the two-way radio antenna 262 to provide bi-directional communication between the operator within the cabin and the other fire fighting forces.

In addition to the instrumentation suite, the emergency fire retardant discharge unit 214 is preferably mounted on a semi-flat surface on the vehicle. When the system is installed on an excavator, a preferred location for the discharge unit is on the engine compartment 110. This location is preferred because the discharge unit 214 can be securely mounted on the engine compartment 110, and because the engine compartment 110 is centrally located on the system. It should be appreciated, however, that if a different type of vehicle is used, the discharge unit may be mounted elsewhere. For example, were a bulldozer to be used, the discharge unit 214 could be installed on the roof of the operator's compartment or on the engine compartment. In any case, the discharge unit is preferably mounted on the vehicle in a central location where, when activated, the fire retardant chemicals 218 will spray sufficiently to protect all sides of the system 100.

Once the tee bar assembly 124, instrumentation suite, and emergency fire retardant discharge unit 214 are attached to the excavator 102, all exterior surfaces of the system are covered with the fire shield panels 234. Due to the extreme heat that will be present in the fire fighting environment, it is important that all exposed surfaces are protected with a fire shield panel 234. Because the hydraulic hoses and other flexible components of the construction excavator are exposed, a combination of both the rigid fire shield panels and flexible fire shield panels is required to adequately cover the system of the present invention. Once covered, the fire shield panels protect the excavator 102, tee bar assembly 124, instrumentation suite and, most importantly, the operator, from exposure to the extreme heat present in the fire fighting environment. This protection allows the fighting of a fire at point-blank range, thereby increasing the usefulness of the system while simultaneously decreasing the danger to its operators.

The operation of the system of the present invention includes positioning the vehicle at the front line of a fire. Once positioned, the operator establishes communications with other fire fighting personnel to coordinate the movement of the system of the present invention. Then, by viewing the monitors within the cabin, the operator may visualize the surrounding area with the video camera, the areas having the most intense heat with the infrared video camera, the overall topography of the area with the GPS/GIS monitor, and the presence of any unknown obstacles with the radar monitor. Thus, by simply viewing the monitors within the cabin, the operator may fully understand the entire fire fighting environment, and attack the fire accordingly.

Once the operator has determined a plan for attacking the fire, the operator positions the system 100 with the tee bar 126 positioned adjacent the fire line using the boom 104, boom ram 114, crowd 116, crowd ram 118, and bucket ram 122, such that the training wheels 150 are on the ground 152. Then, the tee bar ram 160 is adjusted so that the tee bar head 128 and tee arms 130 are perpendicular to the fire, and the motor rams 208 are adjusted so that each motor shaft 134 is perpendicular to the tee arms 130.

Prior to attacking the fire, the operator activates the hydraulic motors 132 thereby spinning the cutting elements 138 in either a clockwise, or counterclockwise direction. Such direction selection is determined by whether the system 100 is attacking from a position where the fire is on the left of the vehicle, or from a position where the fire is on the right of the vehicle. For example, if the fire is on the left of the vehicle, the rotation as viewed from the operator would be clockwise. This clockwise rotation would cause the burning debris on the ground to be thrown to the left as it struck by the severe duty fire whips 146. Likewise, as any burning vegetation which is struck with the cutting elements 138 is also thrown to the left. Thus, as the system 100 advances along the fire line, the burning debris is thrown back into the fire, leaving a fire-free path with no combustible material.

Once the fire has been successfully extinguished, the system 100 may be loaded onto a trailer for movement to another fire location. In order to fit on the trailer, the tee arms 130 must be bent upwards from the tee bar head 128. This movement is accomplished by removing the tee arm pin 188 and activating the tee arm rams 162 to lift the ends of the tee arms upward. Once the tee arms 130 are raised, the width of the system is small enough to fit on the standard excavator trailer for easy transport. Additionally, in the event the excavator 102 should be returned to regular service, the instrumentation suite and fire shielding 234 may be easily removed and stored for future use.

DESCRIPTION OF AN ALTERNATIVE EMBODIMENT

Figure 15:
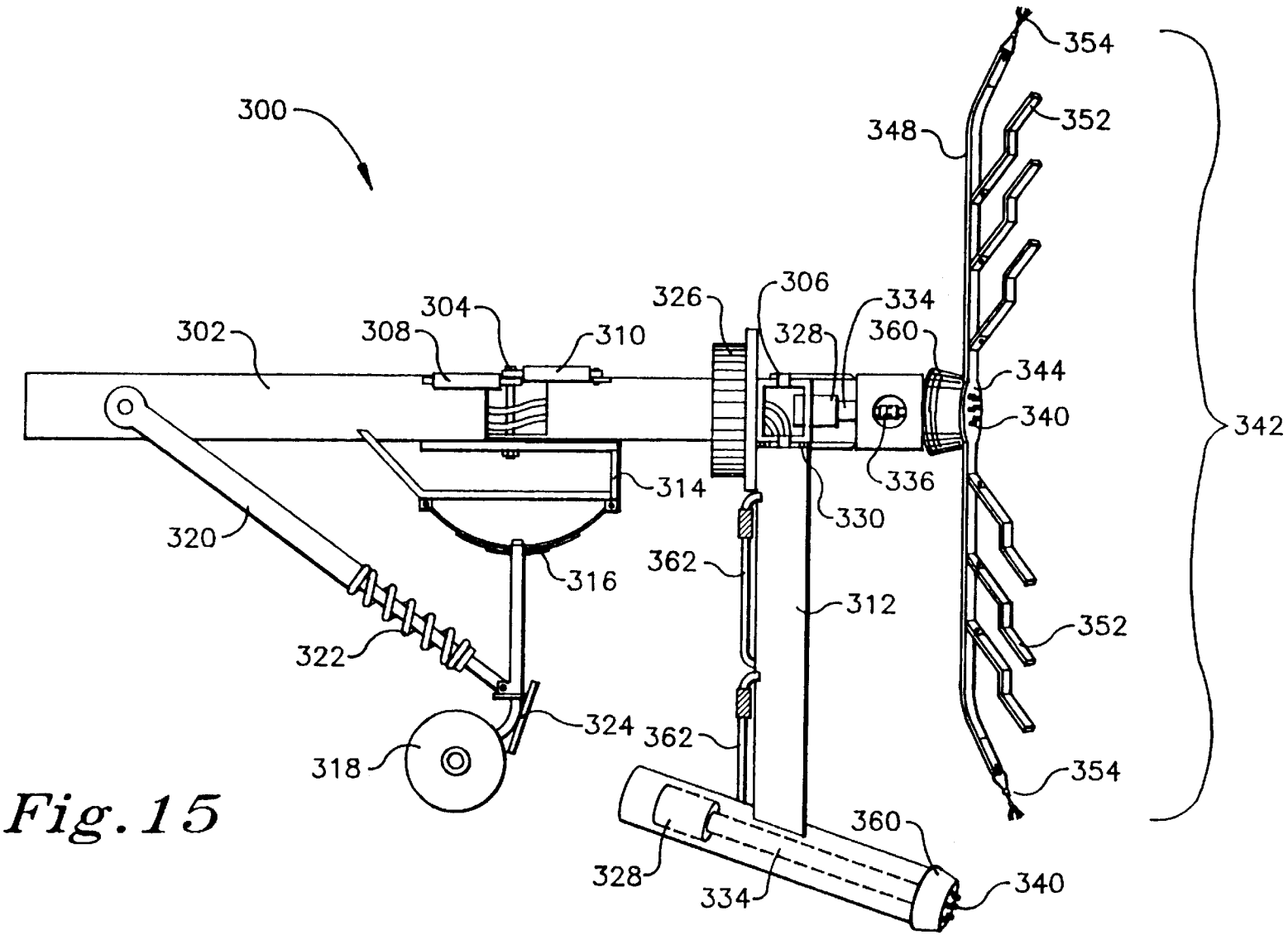
FIG. 15 is a side view of an alternative embodiment of the tee bar assembly of the present invention showing the hinging of the tee arms and the orientation of the motor and blade support member.

In an alternative embodiment of the present invention, the construction excavator is equipped with an improved tee bar assembly 300 that is shown in FIG. 15. As with the tee bar assembly 300 of the above-described embodiment, the improved tee bar assembly 300 extends from the crowd 116 (not shown in this Fig.) and is attached to the bucket ram 122. More specifically, the tee bar assembly 300 includes a tee bar 302 which is attached to, and extends forward from, the crowd 116. Midway along the length of the tee bar 302, a tee bar hinge 304 is formed which allows the tee bar head 306 to be moved in a side-to-side motion. Perhaps more clearly shown in FIG. 16., this motion is controlled by the tee bar ram 308 which is attached at one end to the tee bar 302, and at the other end to the tee bar linkage 310. Specifically, if the tee bar ram 308 is extended, the tee bar head 306 and tee arms 312 will rotate to the left of the excavator 102. Similarly, if the tee bar ram 308 is compressed, the tee bar head 306 and tee arms 312 will rotate to the right of the excavator 102.

Referring back to FIG. 15, the tee bar assembly 300 is supported by a support frame 314 which extends downward from the tee bar 302. The support frame 314 includes a pair of leaf springs 316 which provide a limited degree of resilience for support of the tee bar assembly 300. These leaf spring 316 have sufficient weight-carrying capacity to adequately support the weight of the tee bar assembly 300 without requiring assistance from the excavator itself. This autonomy allows the operator of the system to focus her attention on the dynamic aspects of the fire environment as a whole, instead of the elevation of the tee bar assembly 300.

A pair of casters 318 are mounted to the support frame 314 in such a manner as to allow the casters 318 to swivel beneath the tee bar assembly 300. This allows the tee bar assembly 300 to be adequately supported, regardless of the direction of travel of the system. In fact, even if the tee bar assembly 300 is advancing sideways, the casters 318 swivel to provide the needed support.

A spring strut 320 extends rearwards from each caster 318 for attachment to the tee bar 302 to provide additional support to the support frame 314. Specifically, the spring 322 on the spring strut 320 maintains the proper position of the caster 318 underneath the support frame 314. In the event that the caster 318 strikes an obstacle which it too large to roll over, the brush guard 324 will strike the rock and force the entire caster 318 backwards against the spring 322 and spring strut 320. As the tee bar assembly 300 is advanced, the caster 318 is forced rearwards and upwards pivoting at its attachment to the leaf spring 316. Once the obstacle passes, the spring 322 and spring strut 320 force the caster 318 back to its original position underneath the tee bar assembly 300.

Still referring to FIG. 15, a rotating gear 326 is mounted between the tee bar 302 and the tee bar head 306 such that the tee bar head 306 may be rotated perpendicularly to the tee bar 302. As will be discussed in connection with FIG. 16, the rotating gear 326 allows the tee bar head 306 and tee arms 312 to be rotated so that the motors 328 may be angled towards the fire, regardless of whether the fire is on the left or right of the excavator 102.

Continuing with FIG. 15, a pair of tee arms 312 extend from the tee bar head 306. The tee arm 312 is shown in its down position, with the tee arm hinge 330 open. This allows the system 100 to be trailered as discussed above in connection with the above-described embodiment of the present invention. However, in this alternative embodiment, instead of using a tee arm ram 162, the tee arm 312 is manually raised to be level with the top of the tee bar head 306, and a hinge pin 332 is inserted. Likewise, when it is time to lower the tee arms 312, the hinge pins 332 are simply removed and gravity causes the tee arms 312 to collapse towards the ground.

Extending forward from the tee bar head 306 is a motor shaft 334 which is coupled to a lovejoy 336, or shock-absorbing universal joint. The other end of the lovejoy 336 is attached to the motor shaft plate 338 (shown in FIG. 18). Consequently, as the motor 328 is energized, the motor shaft 334 begins to rotate, which in turn causes the lovejoy 336 to rotate, which causes the motor shaft plate 338 to also rotate.

The motor shaft plate 338 is formed with a number of mounting studs 340 which extend forwards to facilitate attachment of the rotating cutting blade assembly 342. Specifically, the hub 344 of the blade support 346 slides over the mounting studs 340 and is secured using nuts 346. Once mounted, the rotating cutting blade assembly 342 will rotate when the motor shaft 334 rotates, with the lovejoy 336 absorbing any shock experienced by the blade support 348.

Figure 16:
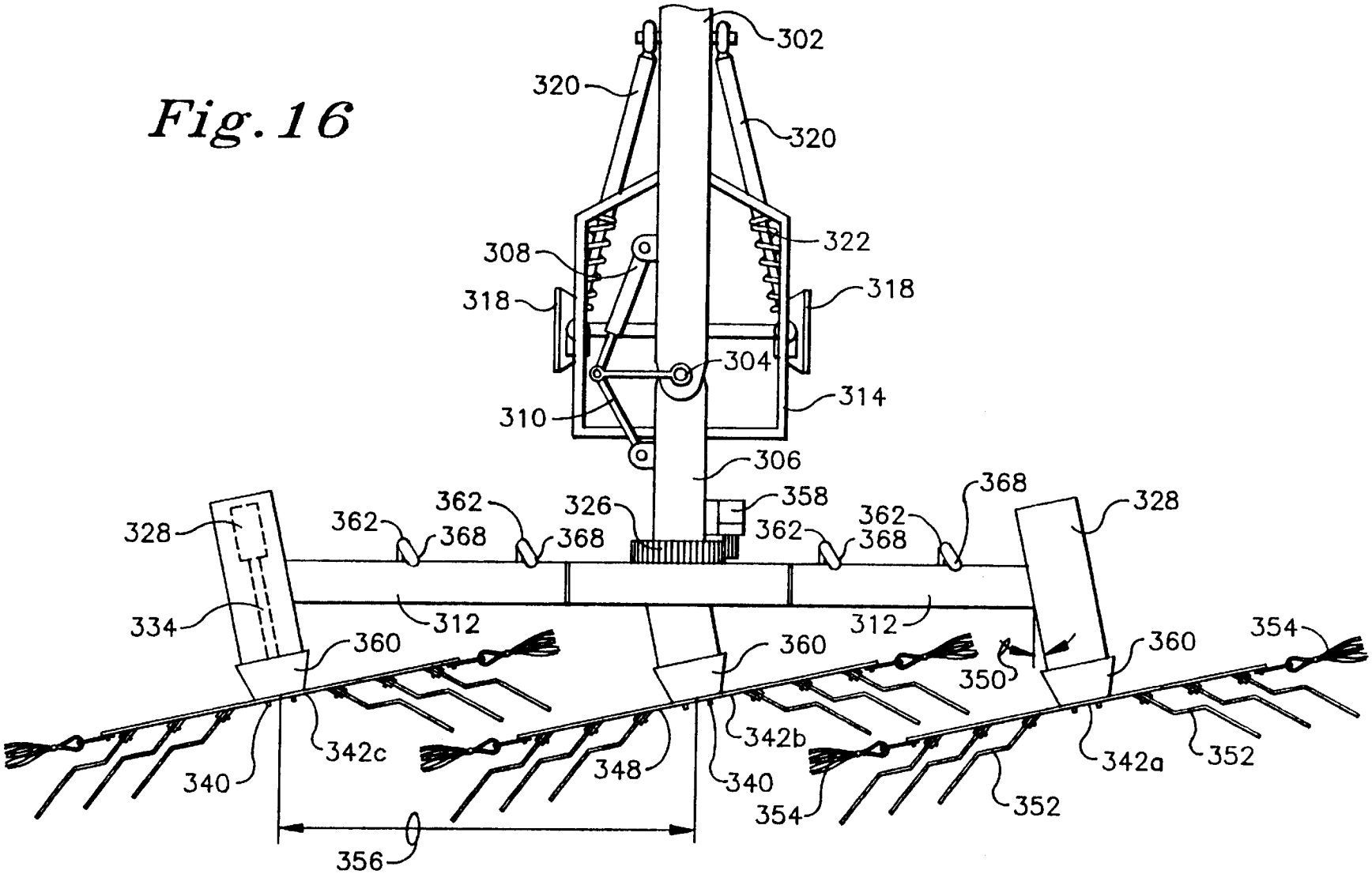
FIG. 16 is a top view of an alternative embodiment of the present invention showing a tee bar assembly having a rotatable tee bar head and tee arms having the motors fixed at an angle to the tee arms.

Referring now to FIG. 16, the tee bar assembly 300 of the alternative embodiment of the present invention is shown from the top. As discussed in conjunction with FIG. 15, the support frame 314 is shown underneath the tee bar 302 and is shown with the two casters 318. From this view, the angular attachment between the tee bar 302 and the spring struts 320 is clear. Specifically, the spring struts 320 are angled inwards from the casters 318 to the tee bar 302. This forms a triangle-shaped support that allows either one or both of the spring struts 322 to be activated without losing the benefit of the support. In fact, because each caster 318 is independently moveable, the entire tee arm assembly 300 could be supported by one caster 318. The ability to support the tee arm assembly 300 with only one caster 318 is particularly useful when an obstacle of significant size strikes one caster 318, forcing that caster 318 entirely off of the ground.

Also from FIG. 16, the tee bar hinge 304 is shown with the associated tee bar linkage 310. As can be appreciated, the tee bar ram 308 controls the movement of the tee bar head 306 with respect to the tee bar 302. More specifically, as the tee bar ram 308 is extended, the linkage 310 swings counter-clockwise forcing the tee bar head 306 away from the tee bar ram 308. Similarly, when the tee bar ram 308 is contracted, the tee bar linkage 310 swings clockwise, forcing the tee bar head 306 towards the tee bar ram 308. As mentioned in conjunction with FIG. 2, the articulation of the tee bar hinge 304 facilitates the system attacking a fire line which is parallel to the path of the vehicle.

Mounted to the tee bar head 306 is a motor 328. Unlike the above-described embodiment, the motor 328 of the alternative embodiment is firmly attached to either the tee bar head 306 or tee arms 312 at a particular angle 350. As shown, this angle 350 is approximately fifteen degrees from perpendicular from the tee bar head 306. This angle 350 is particularly important due to the overlap of the blade supports 348 and swinging cutting blades 352. More specifically, the three motors 328 are attached to the tee bar head 306 and tee arms 312 such that the swinging cutting blades 352 and severe duty fire whip 354 overlap between the motors 328. Thus, in order to insure that the cutting blades 352 do not strike one another, the angle 350 must be maintained. It should also be appreciated that the distance 356 between the motors 328 is also important. Specifically, because the cutting blades 352 overlap, it is necessary to provide sufficient separation such that the fire whip 354 on one blade support 348 does not strike the neighboring motor 328. While the particular distance 356 is not critical, it is important that a minimum clearance is maintained.

The function of the swinging cutting blades 352 and severe duty fire whips 354 can be easily appreciated from this view. As oriented at the angles 350 shown, the motors 328 must rotate clockwise. This is so to insure that any debris cut or swept by the right-most cutting assembly 342*a* will pass to the left. Likewise, any debris either passed by the right-most cutting assembly 342*a* or cut by the center cutting assembly 342*b*, will be passed to the left. Finally, any debris passed from the center cutting assembly 342*b*, or cut by the left-most cutting assembly 342*c* will be passed to the left and out of the path of the system 100. In this manner, a clean path, devoid of any combustible material, is cleared as the system 100 advances forward. Because the cutting blade assemblies 342, as positioned on the tee bar head 306 and tee arm 312, sweep combustible material from right to left, the system must be attacking the fire with the fire line to the right of the system. This is so that the combustible material is thrown back into the fire, establishing a fire break where no fire could be supported.

Because it is not always possible to attack a fire with the fire line on the right, the tee bar head 306 is formed with a rotating gear 326 which is engaged with a gear motor 358. The rotating gear 326 and gear motor 358 facilitate the rotation of the tee bar head 306 and tee arms 312 such that the angle 350 of the motors 328 may be effectively reversed. Specifically, by rotating the rotating gear 326, the right-most motor 328 will be repositioned as the left-most motor 328. As can be appreciated, the rotation of the rotating gear 326 is particularly important when the motors 328 are fixed at an angle 350 to the tee bar head 306 and tee arms 312. Once rotated, the cutting blade assemblies 342 are angled to pass debris from left to right thereby enabling the system to attack a fire with the fire line on the left.

In order to minimize the torques experienced by the tee bar arms 312, the motors 328 which are mounted on the ends of the tee arms 312 are positioned behind the tee arm. Perhaps more clearly shown in FIG. 15, the motor 328 extends rearwards of the tee arm 312 with the shaft 334 extending forwards of the tee arm 312 to the motor shaft plate 338. This positioning effectively minimizes the torques which are experienced by the motor 328 and motor shaft 334. Specifically, because the motor 328 is behind the tee arm 312, and the motor shaft plate 338 is in front of the tee arm 312, any torque caused by the rotating cutting assembly 342 is balanced across the tee arm 312. This balancing minimizes the torque which would cause the motor 328 to vibrate due to the cutting blades 352 striking debris and vegetation.

As shown in this Fig., the motor shaft plates 338 are covered with a shroud 360. This shroud 360 is intended to protect the motor shaft plate 338 and associated motor 328 and bearings from damage incurred while fighting a fire at point blank range. The shroud 360 is formed with a hole pattern which matches the pattern of the mounting studs 340 on the motor shaft plate 338 so that in the event the shroud 360 is damaged, the cutting blade assembly 342 may simply be unbolted, a new shroud 360 installed, and the blade assembly 342 replaced.

In an effort to further combat the fire, a number of post-combustion air tubes 362 are positioned to assist the cutting blade assemblies 342 in the passing of the debris from one side of the system to the other. As shown, the air tubes 362 extend both upward and downward from the tee arms 312 and are supplied with post-combustion air This post-combustion air passes through the air tubes 362 and out nozzles 368. Such post-combustion air is readily available from the vehicle of the system. Specifically, the exhaust from the engine which powers the vehicle may be recirculated through a compressor and forced out the air tubes 362. Because the exhaust has already passed through the engine, there is little oxygen remaining to support combustion. By forcing this out the air tubes 362 and towards the fire, the fire is being deprived of its needed oxygen, thereby helping to extinguish the fire. It is to be appreciated that the post combustion air may be directed through the air tubes 362 without the aid of a compressor. However, this would place an added strain on the vehicle's engine which would result in a decrease of the engines efficiency and increase its operating temperature. When operating in a severe fire fighting environment, the increase of the operating temperature of the engine is highly undesirable, in which case a post-combustion air compressor is almost always needed.

Although post-combustion air is most effective, it has also been found that atmospheric air can be forced through the air tubes 362 and will also assist in extinguishing a fire. This is so because, despite its oxygen content, the forced air decreases the surrounding temperature of the fire environment. By decreasing the temperature of the surrounding environment, the fire is deprived of yet another required element of a fire, namely heat.

Figure 17:
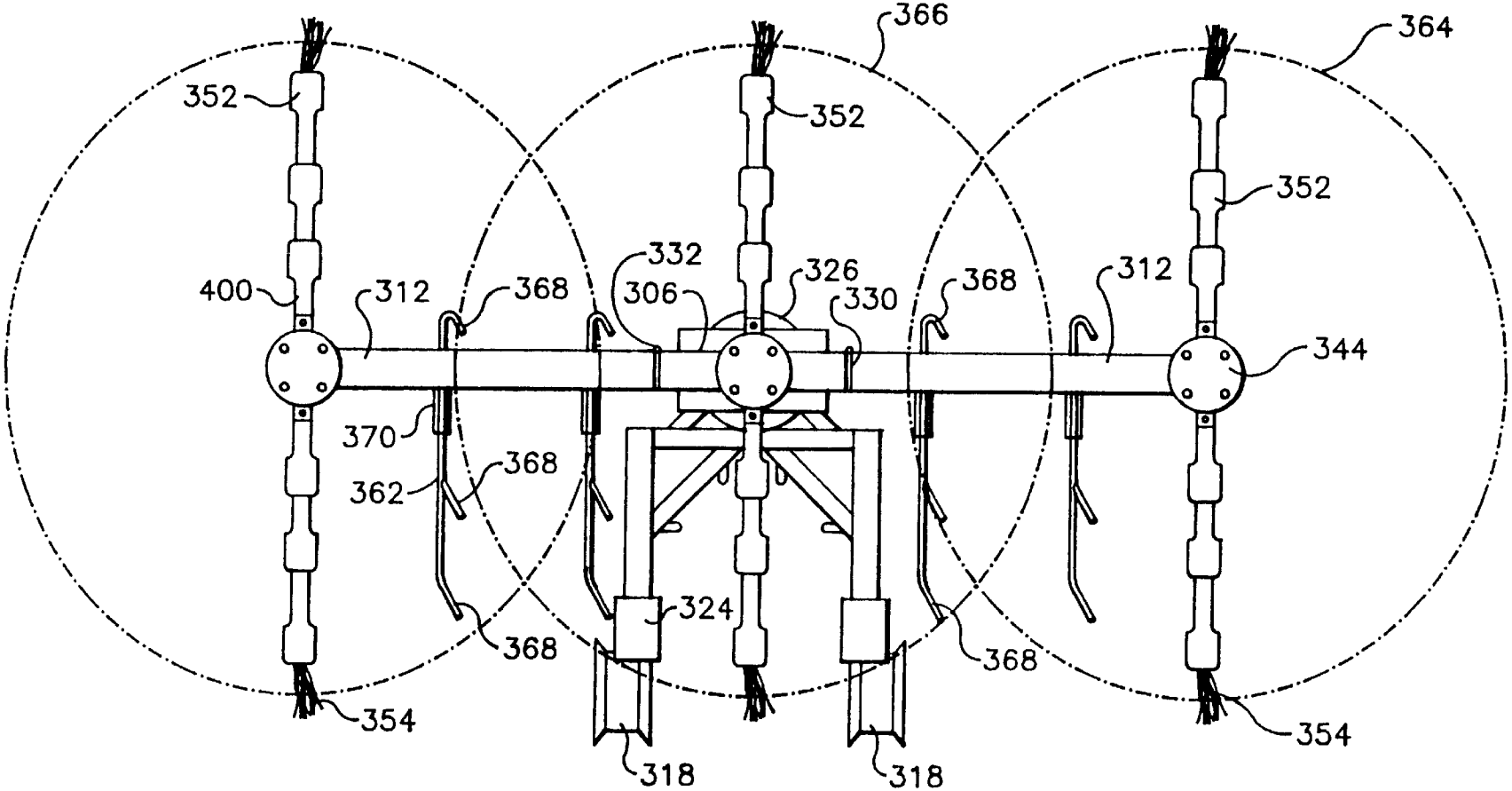
FIG. 17 is a front view of an alternative embodiment of the present invention showing the air injection nozzles and overlap of the swinging cutting blades.

Referring now to FIG. 17, a front view of the tee bar assembly 300 of the alternative embodiment is shown. From this view, the overlapping paths of the cutting blade assemblies 342 is clearly shown. More specifically, the right-most motor rotates counter clockwise, causing the cutting assembly 342*a* to trace out a first sweep 364. Similarly, the center motor rotates counter-clockwise to trace out a second sweep 366. As can be easily seen, the first sweep 364 and the second sweep 366 overlap. Thus, from this view, the importance of the angle 350 of the motors 328 as positioned on the tee bar head 306 and tee arms 312 is clear. Moreover, the distance 356 between the motors is also clearly shown from the traces 364,366 of the cutting assemblies.

Also shown clearly in this Fig., the tee arm hinges 330 are in their closed positions. It is to be appreciated that if the tee arm hinge pins 332 were to be removed, the tee arms 312 would fall downwards. For example, if the right tee arm hinge pin 332 were to be removed, the right tee arm 312 would rotate clockwise with the motor 328 lowering towards the ground.

The air tubes 362 are shown extending upwards and downwards from the tee arms 312 and formed with a number of air nozzles 368. The air nozzle 368 is formed such that the direction of air flow is towards the fire. Specifically, as the cutting blade assemblies 342 rotate counter-clockwise, the debris from the left-most cutting assembly 342*a* is passed to the right. The two air tubes 362, with their corresponding air nozzles 368, direct post-combustion air towards the right thereby assisting the movement of the debris. In order to maintain the proper positioning of the air tubes 362 despite the hazardous environment, a spring sleeve 370 is positioned towards the top of the air tube 362. This spring sleeve 370 provides the necessary resilience such that when the air tube 362 is forced out of position, the spring sleeve 370 returns the air tube 362 to its proper position.

Each air tube 362 is attached to the back of the tee arms 312 by a rotating pressurized air fitting (not shown). This fitting allows the air tubes 362 to rotate in a plane about the fitting and perpendicular to the back of the tee arm 312. This rotation enables the repositioning of the air nozzles 368 when the tee bar head 306 and tee arms 312 are rotated using the rotating gear 326. In operation, the air tubes 362 will hang downwards due to the force of gravity. As the tee bar head 306 and tee arms 312 are rotated to reverse the angle 350 of the motors 328, the force of gravity maintains the air tubes 362 in a downward position. Thus, following the rotation of the tee bar head 306 and tee arms 312, the air tubes 362 are re-positioned to direct the post-combustion air in the direction of the fire line.

FIG. 17 also provides a clear view of the casters 318 and associated support frame 314. As mentioned in conjunction with FIG. 15, it is to be appreciated that each of the casters 318 is independently attached to the support frame 314 such that in the event one caster 318 strikes an obstacle, the other caster 318 can maintain support of the tee bar assembly 300. Also, the brush guard 324 which protects the caster 318 from injury from the fire environment is clearly shown in this view.

Figures 18, 19, 23, 24:
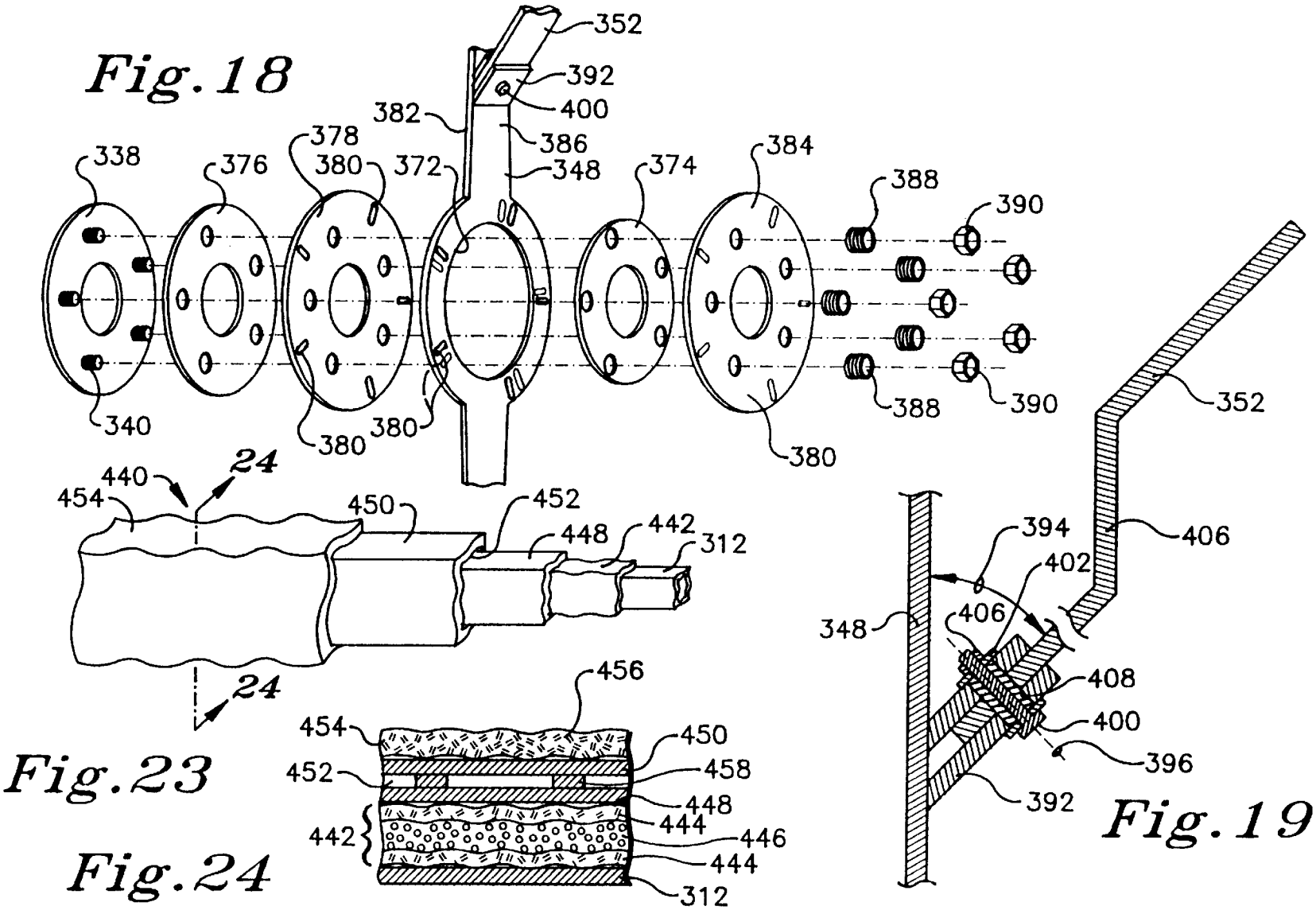
FIG. 18 is a detail view of an alternative embodiment of the present invention showing the clutch components of the rotating cutting blade assembly.
FIG. 19 is a cross-sectional view of the blade support and blade bracket holding a swinging cutting blade.
FIG. 23 is a perspective view of a tee arm showing the various layers of fire protective material.
FIG. 24 is a cross-sectional view of the fire protective materials as taken along line 24—24 in FIG. 23.

Referring now to FIG. 18, the cutting blade assembly 342 is shown in detail. Specifically, the blade support 348 is formed with a hub 344 having a circular passageway 372 through its center. This circular passageway 372 is sized to fit a hub spacer 374 having a thickness similar to the thickness of the blade support 348. From this view, the attachment of the cutting blade assembly 342 to the motor shaft plate 338 is easily understood. A spacer 376 is positioned over the mounting studs 340 which extend from the motor shaft plate 338. After positioning of the spacer 376, an inside clutch plate 378 is also positioned over the mounting studs 340. This inside clutch plate 378 is formed with a series of clutch tabs 380 that are slightly raised from the surface of the clutch plate 378. The tabs 380 are created by placing a weld bead on the surface of the steel clutch plate 378. However, it should be appreciated that any method of forming a clutch tab 380 could be used. Once the inside clutch plate 378 is positioned over the mounting studs 340, the hub spacer 374 is also positioned over the inside clutch plate 378. The circular passageway 372 of the blade support 348 is positioned over the hub spacer 374 such that the clutch tabs 380 on the inside clutch plate 378 interlock with the clutch tabs 380 located on the inside surface 382 of the blade support 348. Next, the outside clutch plate 384, which is also formed with a series of clutch tabs 380, is installed over the mounting studs 340 such that its clutch tabs 380 interlock with the clutch tabs 380 on the outside surface 386 of the blade support 348. Once all plates are positioned over the mounting studs 340, a compression spring 388 and retaining nut 390 hold the blade support 348 in position.

Once all of the interlocking clutch tabs 380 are positioned on the mounting studs 340, and the compression spring 388 and retaining nut 390 are installed, the cutting blade assembly 342 is firmly mounted to the motor shaft plate 338. As the motor 328 rotates, the motor shaft plate 338 rotates causing the mounting studs 340 to also rotate. The rotation of the mounting studs 340 causes both the inside and outside clutch plates 378,384 to rotate thereby engaging the clutch tabs 380 on the blade support 348. Once the clutch tabs 380 are engaged, the cutting blade assembly 342 begins to rotate. It is to be appreciated, however, in the event that the cutting blades 352 strike an object having sufficient size to slow the rotation of the cutting blade assembly 342, the compression spring 388 will allow the clutch plates 378,384 to separate. This separation allows the clutch tabs 380 to slip against each other allowing the motor 328 to continue rotating while the cutting blade assembly 342 regains its rotational speed. At the point when the rotational speed of the cutting blade assembly 342 matches the rotational speed of the motor 328, the compression spring 388 forces the clutch plates 378,384 together, engaging the clutch tabs 380 together again. It should be appreciated that compression springs 388 having different spring constants could be used in order to achieve different levels of clutch slipping strength. In other words, the stronger the compression spring 388, the larger object it will take to disengage the rotation of the motor 328 from the rotation of the cutting blade assembly 342. Additionally, some degree of clutch sensitivity may be selected by tightening the retaining nuts 390 more or less. The more the retaining nut 390 is tightened, the stronger the force between the clutch plates 378,384. On the other hand, the less the retaining nut 390 is tightened, the lesser the force between the clutch plates 378, 384.

Referring now to FIG. 19, the cutting blade assembly 342 is shown in cross-section. From this view, the attachment of the cutting blade 352 to the blade support 348 is more clearly shown. Specifically, the blade support 348 is formed with a blade bracket 392 which consists of two parallel plates that extend from the blade support 348 at a pre-determined angle 394. This angle 394 is important in order to allow free swinging of the cutting blade 352 about the pivot axis 396 while insuring that the blade 352 does not strike any other portion of the cutting blade assembly 342. Each of the parallel plates of the blade bracket 392, as well as the cutting blade 352 itself, is formed with a circular hole sized to receive a cylinder 398. To mount the cutting blade 352 to the blade support 348, the end of the cutting blade 352 is inserted into the blade bracket 392 such that the circular hole in the cutting blade align with the circular holes in the parallel plates. Once aligned, the cylinder 398 is inserted through the circular holes such that the cutting blade 352 can rotate about the pivot axis 396 of the cylinder 398. Once positioned, a retaining pin 400 is inserted through the cylinder 398 and held in place with a washer 402 and nut 404. As designed, the cutting blade 352 can swing freely about the pivot axis 396 with the entire force of that swing being transferred to the cylinder 398. As a result, it is important that the cylinder 398 be made of a strong material. Such materials could include, for example, hardened steel. It should be noted, that in addition to the cylinder 398 being made of hardened steel, all other components of the cutting blade assembly 342 can be made of the same material. In such an instance, the life of the cutting blades 352 and blade support 348 would be extended as long as possible.

In addition to the mounting structure, the particular shape of the cutting blades 352 are shown in FIG. 19. More specifically, the cutting blade 352 is formed with a bend 406 which provides a significant benefit over a straight cutting blade. Namely, by introducing a bend 406 into the cutting blade 352, the forces which are exerted on the sharpened portion of the blade are lessened. More particularly, because there is a bend 406 in the blade, the torque about the pivot axis 396 is lessened due to the effective shortening of the cutting blade 352, as well as the introduction of the rotational torque perpendicular to the pivot axis 396.

With reference back to FIG. 18, it is to be appreciated that every element of the cutting blade assembly 342 is replaceable. More specifically, each cutting blade 352 may be easily replaced by simply removing the retaining pin 400, removing the cutting blade 352, and reinstalling another cutting blade 352. Similarly, the severe duty fire whip 354 may be easily be replaced by removing the retaining pin 400, removing the fire whip 354, and re-installing another fire whip 354. Also, in the event that the entire cutting blade assembly 342 is damaged, the retaining nut 390 and compression spring 388 may be removed allowing for easy replacement of the entire assembly 342.

Figure 21:
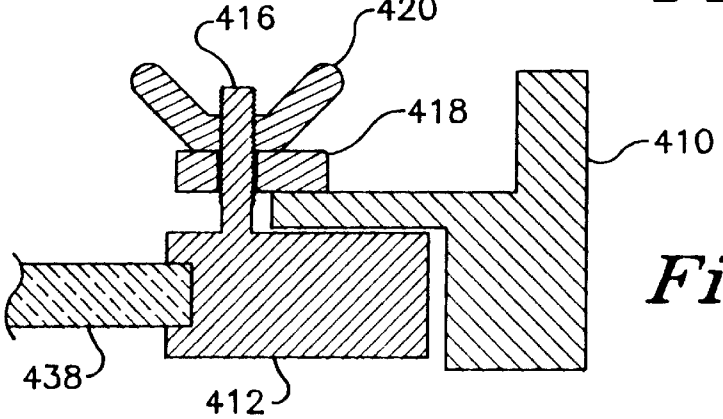
FIG. 21 is a cross-sectional view of the removable instrumentation frame taken along line 21—21 in FIG. 20.
Figure 20:
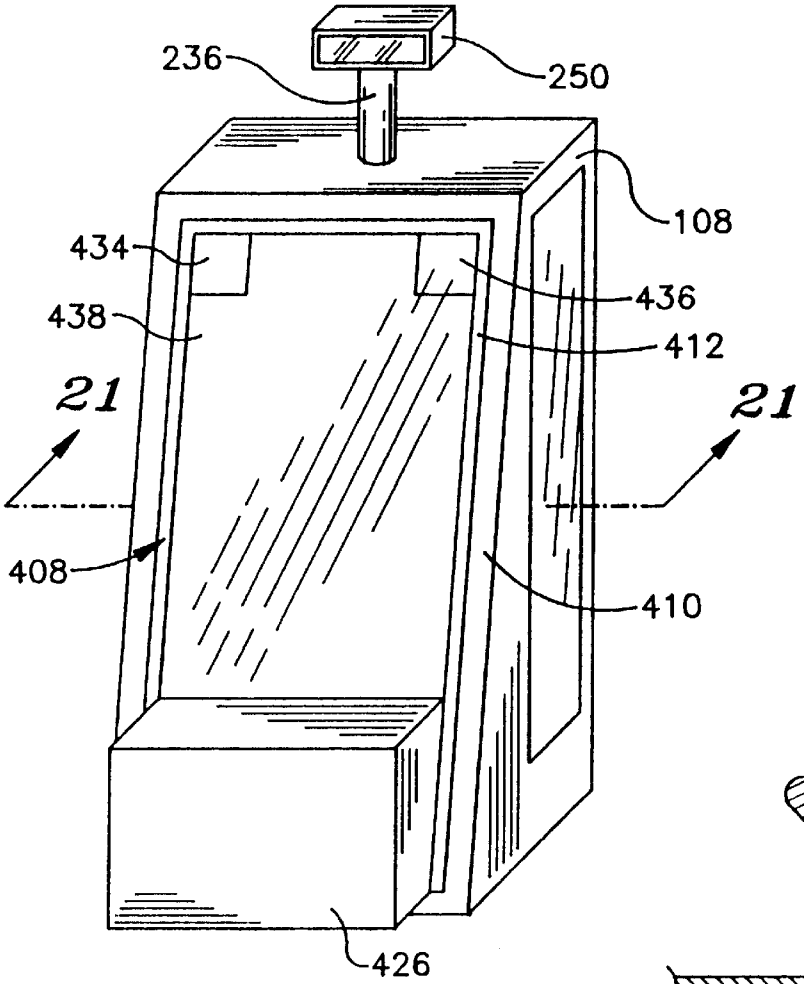
FIG. 20 is a perspective view of the excavator cabin showing the removable instrumentation frame.

Referring now to FIG. 20, the cabin 108 of a construction excavator 102 is shown as equipped with a modular instrumentation assembly 408 and instrumentation periscope 236. The cabin 108 is ordinarily equipped with a removable front window. To install the modular instrumentation assembly 408 into an excavator 102, the original front window is removed from the excavator frame 410 and the assembly 408 is inserted in its place. To assist in this installation, the instrumentation frame 412 is equipped with a number of clamping brackets 414. A representative clamping bracket 414 is shown in FIG. 21 and includes a clamping shaft 416 which extends from the back side of the instrumentation frame 412 and into the cabin 108. A clamping block 418 slides over the clamping shaft 416 and is secured in place with the thumb screw 420. Thus, once installed, the clamping bracket 414 securely mounts the instrumentation frame 412 to the cabin frame 410. Due to this simple method of mounting, it is likewise simple to remove the instrumentation assembly 408 from the excavator 102. This is particularly useful when the excavator 102 is being used for ordinary purposes when not involved in fighting fires.

Figure 22:
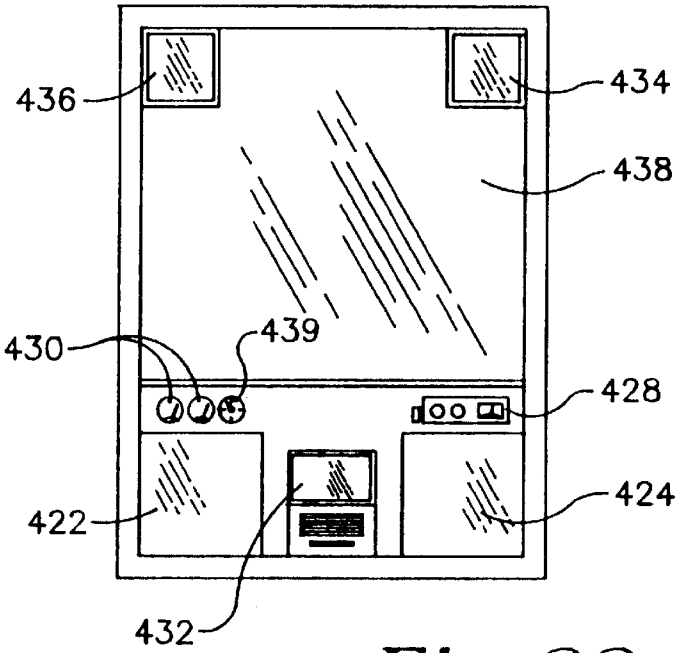
FIG. 22 is a plan view of the inside of the removable instrumentation frame showing the location of various instruments.

Referring now to FIG. 22, the inside of the instrumentation assembly 408 is shown. Specifically, a number of monitors 422,424 are mounted in the instrumentation rack 426 located towards the bottom of the instrumentation frame 412. The location of the rack 426 is important because it allows the placement of larger monitors 422,424 while insuring that the operator of the system 100 has an unobstructed view of the fire environment. Moreover, because the instrumentation rack outwaxtends outward from the cabin 108, there is no interference with the operation of the foot pedals of the excavator 102.

As shown, two larger monitors 422,424 are positioned in the lower portion of the instrumentation rack 426. These monitors could display, for example, the outputs from the GPS/GIS and the radar system. Also located in the instrumentation rack, a two-way radio 428 provides two-way communication between the system operator and other fire fighting forces. Also, an array of temperature sensors 430 are mounted in the instrumentation rack 426 to provide the operator of the system an instantaneous update of the surrounding temperatures, or temperatures of critical elements of the system. Compass 439 is mounted to the instrumentation assembly to provide a directional indicator to the operator, and can be used as an analog verification of the electronic instrumentation data provided by the GPS/GIS systems. Also located in the instrumentation rack is a computer 432. As shown, a laptop computer is being used to interface all of the electronic instrumentation. While such a computer 432 is fully capable of the required computations, a ruggedized computer could also be used to improve the durability of the system.

Towards the top of the instrumentation frame, a pair of smaller monitors 434,436 are mounted. These monitors could be used to display the standard video and infrared video images from the periscope-mounted cameras. Thus, by looking out the front of the cabin 108, the operator may gain insight into both the visual surroundings, as well as the heat environment, simply be raising his eyes to view the smaller monitors 434,436. Despite the above discussion of the positioning of the monitors, it is to be appreciated that the various monitors may be arranged differently depending on the specific requirements of the operator.

The window 438 of the instrumentation assembly 408 is made of heat resistant, high-silica glass. These materials insure that the excavator cabin 108 can be exposed to severe temperatures while not experiencing cracked glass. Moreover, by installing a heat resistant glass, the safety of the operator is greatly improved.

Referring now to FIG. 23, a fire shield system 440 is shown to identify the various layers of the shielding. The shield system 440 as shown is typical of that shielding on the tee arms 312. However, it is to be appreciated that such shielding could be used on all other portions of the system. The system as shown includes a number of layers. Starting with the most inner layer, the tee bar 312 is covered with a blanket 442 which is formed from two materials. The outer layers 444 of material of the blanket 442 is a high-technology heat-stop material which can withstand 2500 degrees fahrenheit. One such material is ZETEX PLUS which is available from NuTex Industries. Between the two layers 444 of the ZETEX PLUS, a pad 446 formed from a fiber filled weave which prohibits the transmission of heat is installed. One such fiber filled weave material is FIBERFRAX, which is available from Carborundum Corporation. Once positioned together, the ZETEX PLUS layer 444 and FIBERFRAX pad 446 are sewn together to create the blanket 442. This blanket 442 is wrapped around the tee arm 312 and secured in place with an inner heat shield 448. The inner heat shield 448 is a metallic material sized to closely surround the tee arm 312 and blanket 442. The inner heat shield 448 is held in place with screws, however, it is to be appreciated that any manner of attachment of the inner heat shield 448 is acceptable so long as it is capable of withstanding extended exposure to heat.

An outer heat shield 450 is positioned over the inner heat shield 448. However, to assist in the heat insulation, an air gap 452 is maintained between the inner heat shield 448 and the outer heat shield 450. Such an air gap 452 would be approximately one half inch. However, it is to be appreciated that the thicker the air gap 452, the better the heat resistance across that gap. Thus, in areas of high heat exposure, such as on the front and lower side of the tee arms 312, the air gap 452 may be increased.

A layer of heat reflecting material 454 is wrapped around the outer heat shield. Such material may be ZETEX PLUS, but other materials may be used so long as they exhibit the heat deflection ability. To increase the heat deflection ability of the ZETEX PLUS, a metallic coating 456 may be applied to the outer surface of the heat deflecting material 454. Such a coating 456 may be aluminum, but other material could be used so long as they enhance the heat deflection capability of the ZETEX PLUS.

In addition to the various heat deflecting and insulation materials, the tee bar 302, tee bar head 306, and tee arms 312 can also be cooled by passing air through the center of those members. More specifically, because the tee bar 302, tee bar head 306, and tee arms 312 are made from tubular steel, air may be passed through the center of the members to carry away any heat present. This method of cooling further insures the safety of the tee bar assembly 300 by removing any heat which passes through the heat deflecting and insulation materials. In fact, because the motors 328 are also located either in the tee bar head 306, or at the ends of the tee arms 312, they are also cooled by forcing air through the members. This is particularly important to insure that the heat surrounding the motors 328 is minimized.

Referring now to FIG. 24, the heat shield system 440 is shown in cross-section. As shown, the tee arm 312 is wrapped by a blanket 442 of ZETEX PLUS 444 and Fiberfrax 446 and the resulting blanket 442 is held in place by the inner heat shield 448. A spacer 458 is inserted between the inner heat shield 448 and the outer heat shield 450 to create an air gap 452 of about a half inch. On top of the outer heat shield 450, a layer of metal coated FIBERFRAX 454 is wrapped to minimize the exposure of the outer and inner heat shields 448,450 to extreme heat. However, because of the layers of the heat shield system 440, it is possible to remove and replace any layers of the system which become damaged due to exposure to the extreme heat. Specifically, the outer layer 454 of ZETEX PLUS and the outer heat shield 450 may be easily removed and replaced without having to touch the inner heat shield 448. This is particularly advantageous when operating in harsh environments where extreme heat can damage those outer layers.

It is also to be appreciated that in areas of the system which are not going to be exposed to such extreme heat, a lesser heat shielding system 440 may be used. More specifically, in an area of the excavator 102 which is not exposed to such severe heat, the inner and outer heat shields 448,450 may be omitted and the metal coated FIBERFRAX 454 could be sufficient. Such an area could be, for example, the back of the engine compartment.

What is claimed is:

1. A fire fighting assembly, comprising:

a forward assembly mountable on a land-based vehicle forwardly movable over terrain and extendable therefrom in a forward direction of movement of said vehicle;

at least one rotary power drive, each said rotary power drive having a rotatable shaft, each shaft having an axis of rotation parellel to said terrain and parellel to said forward direction of movement, each said rotary power drive mounted to said forward assembly such that said rotatable shaft extends away from said forward assembly and said vehicle in said forward direction; and a plurality of elongated members, each said elongated member having a hub, said hub being attached to said rotatable shaft wherein rotating said rotatable shaft causes said hub to rotate, said elongated member having a radius of rotation extendable to said terrain whereby a portion of an elongated member strikes said terrain to sweep debris while said vehicle moves over said terrain.

2. A fire fighting assembly as recited in claim 1, further comprising:

at least one air nozzle mounted to said forward assembly such that said air nozzle extends away from said forward assembly and said vehicle in said forward direction; and an air source, said air source providing pressurized air and being in fluid communication with said air nozzle wherein said air from said air source is forced though said air nozzle to blow out a fire.

3. A fire fighting assembly as recited in claim 2, wherein said air from said air source is post-combustion air.

4. A fire fighting system, comprising:

a land-based vehicle movable over terrain in a forward direction;

a rotary assembly having at least one elongated member rotatably mounted on said vehicle with respect to an axis of rotation parallel to said terrain and parallel to said forward direction and rotating substantially in a plane perpendicular to said terrain and perpendicular to said forward direction; and a power drive for rotating said elongated member, said elongated member having a radius of rotation extendable to said terrain whereby a portion of said elongated member strikes said terrain to sweep debris while said vehicle moves over said terrain.

5. A fire fighting system as recited in claim 4, further comprising an emergency fire retardant discharge system.

6. A fire fighting system as recited in claim 5, wherein said emergency fire retardant discharge system further comprises:

a sealable fluid container;

a volume of fire retardant fluid in said sealable fluid container;

a flow tube, said flow tube having a first end and a second end, said first end being submerged into said volume of fire retardant fluid and said second end extending out of said sealable fluid container;

a nozzle attached to said second end of said flow tube and in fluid communication therewith; and a means for pressurizing said sealable fluid container to force said fire retardant fluid through said flow tube and out through said nozzle to extinguish a fire.

7. A fire fighting system as recited in claim 6, wherein said means for pressurizing said sealable fluid container comprises:

at least one pressurized container, said pressurized container containing a gas; and a means for puncturing said pressurized container wherein said gas escapes said pressurized container and enters said sealable fluid container to pressurize said sealable fluid container to force said fire retardant fluid through said flow tube and out through said nozzle to extinguish a fire.

8. A fire fighting system as recited in claim 4, further comprising:

a video camera, said video camera being mounted to said vehicle and having a first electronic output signal; and a first monitor, said monitor receiving said first electronic output signal and generating an image therefrom, said first monitor being positioned on said vehicle to allow viewing by the fire fighting system operator.

9. A fire fighting system as recited in claim 4, further comprising:

an infrared video camera, said infrared video camera being mounted to said vehicle and having a second electronic output signal; and a monitor, said monitor receiving said second electronic output signal and generating an image therefrom, said monitor being positioned on said vehicle to allow viewing by the fire fighting system operator.

10. A fire fighting system as recited in claim 4, further comprising:

a plurality of temperature sensors, each said temperature sensor being mounted to said vehicle and having an electronic output signal; and a plurality of temperature gauges, one said temperature gauge electrically connected to one said temperature sensor, said temperature gauge being positioned on said vehicle to allow viewing by the vehicle operator.

11. A fire fighting system as recited in claim 4, further comprising:

a two-way radio, said two-way radio mounted near the vehicle operator to facilitate communication between the operator of said vehicle and other fire fighting forces.

12. A fire fighting system as recited in claim 4, further comprising:

a global positioning system (GPS) receiver, said GPS receiver having an electronic output signal;

a monitor, said monitor being electronically connected to said electronic output signal of said GPS receiver to generate an image therefrom, said monitor being positioned on said vehicle to allow viewing by the fire fighting system operator.

13. A fire fighting system as recited in claim 4, further comprising a compass, said compass being position on said vehicle to allow viewing by the fire fighting system operator.

14. A fire fighting system as recited in claim 4, wherein said rotary assembly comprises:

a forward assembly, said forward assembly mountable on said vehicle and extendable therefrom:

at least one rotary power drive, each said rotary power drive having a rotatable shaft, each said rotary power drive mounted to said forward assembly such that said rotatable shaft extends away from said forward assembly and said vehicle; and a plurality of elongated members, each said elongated member having a hub, said hub being attached to said rotatable shaft wherein rotating said rotatable shaft causes said hub to rotate.

15. A fire fighting system as recited in claim 14, wherein said rotary assembly further comprises:

a plurality of blade brackets, each said blade bracket extending from one of said elongated members and defining an angle therebetween, said blade bracket extending away from said hub, and being formed with a pivot hole;

at least one swinging cutting blade, said cutting blade having a first end and a second end, said first end being formed with a mounting hole; and a pivot pin, said pin insertable through said pivot hole and said mounting hole wherein said cutting blade may freely pivot on said pivot pin.

16. A fire fighting system as recited in claim 14, wherein said rotary assembly further comprises:

at least one fire whip, each said fire whip extending radially from one of said elongated members to sweep vegetation aside when said blade support is rotated.

17. A fire fighting system, comprising:

a land-based vehicle forwardly movable over terrain;

a tee bar assembly, said tee bar assembly mountable on said vehicle and extendable therefrom in a forward direction of movement of said vehicle;

at least one rotary power drive, each said rotary power drive having a rotatable shaft, each said rotary power drive mounted to said tee bar assembly such that said rotatable shaft extends away from said tee bar assembly and said vehicle;

a plurality of rotary assemblies, each said rotary assembly having a hub, said hub being attached to said rotatable shaft wherein rotating said rotatable shaft causes said hub to rotate;

at least one support, one said support extending radially from said hub such that rotating said hub causes said support to rotate in a plane; and at least one cutting blade, said cutting blade attached to said support and having a radius of rotation extendable to said terrain whereby said cutting blade strikes said terrain to sweep debris while said vehicle moves forwardly over said terrain.

18. A fire fighting system for fighting fires, comprising:

a vehicle;

a tee bar assembly, said tee bar assembly mountable on said vehicle and extendable therefrom:

at least one rotary power drive, each said rotary power drive having a rotatable shaft, each said rotary power drive mounted to said tee bar assembly such that said rotatable shaft extends away from said tee bar assembly and said vehicle;

a plurality of rotary assemblies, each said rotary assembly having a hub, said hub being attached to said rotatable shaft wherein rotating said rotatable shaft causes said hub to rotate;

at least one support, one said support extending radially from said hub such that rotating said hub causes said support to rotate in a plane; and at least one fire whip, each said fire whip extending radially from said blade support to sweep vegetation aside when said blade support is rotated.

* * * * *